US005783824A

United States Patent [19]

Baba et al.

[11] Patent Number: 5,783,824

[45] Date of Patent: Jul. 21, 1998

[54] ION TRAPPING MASS SPECTROMETRY APPARATUS

[75] Inventors: Takashi Baba, Matsuyama; Izumi Waki, Asaka, both of Japan

[73] Assignee: Hitachi, Ltd., Tokyo, Japan

[21] Appl. No.: 886,359

[22] Filed: Jul. 1, 1997

Related U.S. Application Data

[63] Continuation-in-part of Ser. No. 626,560, Apr. 2, 1996, Pat. No. 5,679,950.

[30] Foreign Application Priority Data

Apr. 3, 1995 [JP] Japan ..... 7-077517
Jul. 2, 1996 [JP] Japan ..... 8-172023

[51] Int. Cl.[6] ..... H01J 49/42

[52] U.S. Cl. ..... 250/281; 250/292

[58] Field of Search ..... 250/281, 282, 250/291, 292

[56] References Cited

U.S. PATENT DOCUMENTS

| | | | |
|---|---|---|---|
| 2,939,952 | 6/1960 | Paul et al. | 250/41.9 |
| 4,540,884 | 9/1985 | Stafford et al. | 250/282 |
| 4,736,101 | 4/1988 | Syka et al. | 250/292 |
| 4,755,670 | 7/1988 | Syka et al. | 250/292 |
| 5,420,425 | 5/1995 | Bier et al. | 250/292 |
| 5,679,950 | 10/1997 | Baba et al. | 250/281 |

FOREIGN PATENT DOCUMENTS

WO97/02591 1/1997 WIPO .

OTHER PUBLICATIONS

Physical Review Letters, vol. 68, No. 13, 30 Mar. 1992, Waki et al.: *Observation of Ordered Structures of Laser--Cooled Ions in a Quadrupole Storage Ring*, pp. 2007–2010.

Journal of Applied Physics, vol. 40, No. 8, Jul. 1969, D.A. Church: *Storage–Ring Ion Trap Derived from the Linear Quadrupole Radio–Frequency Mass Filter*, pp. 3127–3134.

Physics Scripta, vol. T22, 1988, B.I. Deutch et al.: *Antihydrogen Production by Positroniuym–Antiproton Collisions in an Ion Trap*, pp. 248–255.

Plenum Press, New York & London, Miklos Szilagyi: *Electron and Ion Optics*, pp. 72–75 No Date.

*Primary Examiner*—Kiet T. Nguyen
*Attorney, Agent, or Firm*—Kenyon & Kenyon

[57] ABSTRACT

A mass spectrometry apparatus having a constitution for attaining analysis with high sensitivity and high resolving power comprising a linear radio-frequency quadrupole ion trap and means for avoiding degradation of analysis performance due to field disturbance caused by an end electrode thereof, where said purpose is achieved by means for forming a harmonic potential in the central axis thereof in whose potential ions are resonantly oscillated to be ejected outside of the ion trap for detection along the axis, or by means to eliminate undesirably- degraded signals originating near the ion trap portions that are disturbed by the end electrodes.

11 Claims, 10 Drawing Sheets

ION TRAPPING MASS SPECTROMETRY APPARATUS

CROSS-REFERENCE TO RELATED APPLICATION

This application is a continuation-in-part of U.S. patent application Ser. No. 08/626,560 filed Apr. 2, 1996, now U.S. Pat. No. 5,679,950 and the disclosure of which is incorporated herein by reference.

BACKGROUND OF THE INVENTION

The present invention concerns an ion trapping mass spectrometry apparatus for attaining high detection sensitivity and high mass resolving power by effectively utilizing a linear ion trap. The apparatus can be utilized as a basic technology in a wide variety of industrial fields requiring convenient and highly sensitive mass analysis.

Mass spectrometry is a technique of obtaining information regarding the mass of specimen molecules by ionizing the molecules into charged particles for identifying the species of the molecules, where one measures the mass-to-charge ratio m/e, in which m represents the mass of the ions and e represents the charge of the ions.

Typical mass spectrometry methods are time of flight method, a method of measuring a deflecting direction by magnetic fields, a method of measuring a cyclotron oscillation frequency under magnetic fields, and a method of utilizing stable accumulation conditions by radio frequency electric fields. Since such methods have advantages and drawbacks respectively regarding the extent for the measurable mass range, mass resolving power, detection sensitivity, size, maneuverability and cost, they are used selectively depending on the application.

Among the techniques described above, the mass spectrometry using the radio frequency electric fields has the following features. This mass spectrometry has a mass resolving power capable of distinguishing a difference 1 of the mass-to-charge ratio in a region in which the mass-to-charge ratio m/e is about 1000 or less, the apparatus is small and easy to operate, and can be manufactured at low cost. That is, it offers a mass analysis method at a reduced cost for monitoring, for example, the residual gases of a vacuum system, and detection of residual organic molecules contained in drinking water.

Among the mass spectrometric methods using the radio frequency electric fields, there are two typical methods at present, namely, a radio frequency quadrupole mass filter method (hereinafter referred to as quadrupole mass filter mass spectrometry) and a radio frequency quadrupole ion trapping method (hereinafter referred to as ion trapping mass spectrometry). The quadrupole mass filter is an apparatus comprising a combination of a linear quadrupole radio frequency electric field and a linear quadrupole static electric field each in an appropriate radio frequency field and static electric field such that ions having a specific mass-to-charge ratio are allowed to pass mass-selectively. Mass spectrum can be obtained by scanning the amplitude of the radio frequency field, or the strength of the electrostatic field while maintaining the ratio of the amplitude of the radio frequency and the strength of the static electric field to a constant value. In view of the convenient maneuverability and the long history of its use, the quadrupole mass filter is utilized most generally among the radio frequency mass spectrometric methods.

On the other hand, the ion trapping mass spectrometry is a method of trapping ions three dimensionally to obtain mass spectrum. The ion trapping means that are widely used at present is so-called 3DQ or Paul trap. Since operation methods capable of attaining higher detection sensitivity compared with the quadrupole mass filter spectrometry have been developed in recent years, the application of the ion trapping means has now been extended.

The method of using the Paul trap for mass spectrometry was disclosed for the first time by Paul and Steinwedel in U.S. Pat. No. 2,939,952 (hereinafter referred to as literature 1). This is a method of conducting mass analysis by operating the ion trap under the condition capable of trapping only specific species with specific value of mass-to-charge ratio. However, this method was not utilized generally in the manner as disclosed in the literature 1 since the operation was difficult and satisfactory detection sensitivity and mass resolving power could not be obtained. Then, several effective operation methods for mass spectrometry were further disclosed. Among them, the popular method at present is based on the principle of ejecting ions from the ion trap under selection of mass and detecting them by an ion detector. Two basic methods of the ejection of the ions are described below.

One of the ejection methods is a method of utilizing the instability of the ion trapping. This method was disclosed in U.S. Pat. No. 4,540,884 (literature 2). The conditions for stable ion trapping depends on the frequency and the amplitude of the radio frequency applied to ion trap. Then, ions become instable depending on the mass-to-charge ratio by scanning one of the frequency or the amplitude of the radio frequency field. Ions of the instabilized ion species are successively ejected through a hole perforated in the ion trap electrode. Mass spectrometry is enabled by synchronized detection of the scanned parameter and the number of ions. This operation method is called a mass selective instability operation mode.

Another method is a method of causing ions to resonantly oscillate in the ion trap. In the ion trap, ions undergo a force by the radio frequency field. The force can be approximated as a force in a harmonic potential. The fundamental oscillation in the harmonic potential is generally referred to as a secular motion. Since the frequency of the secular motion is inversely proportional to the mass-to-charge ratio, to measure the mass of the trapped ions, the ions are brought into resonance oscillation by an alternating voltage. The resonant ions are ejected from the trap through a hole in the electrode and detected by secondary electron multipliers. The operation method is referred to as a mass selective resonance ejection operation mode, which is disclosed in U.S. Pat. No. 4,736,101 (literature 3). As a method based on the analogous principle of exciting the resonant oscillation, a method of detecting ions while keeping them in the ion trap without ejection has also been known, where the resonant oscillation is detected through a current induced in the ion trapping electrodes by ions oscillating in the ion trap.

Further, as another method of ion trap mass spectrometry, the present applicants have proposed a mass spectrometric method of indirectly detecting specimen ions by a means for detecting fluorescence of probe ion species, different from the specimen ions, trapped simultaneously with the specimen ions (U.S. patent application Ser. No. 08/626,560 filed Apr. 2, 1996, issued as U.S. Pat. No. 5,679,950; refer to corresponding EP 0736894 if necessary: literature 4).

One of the important parameters representing the performance of mass spectrometry is the detection sensitivity. Another important parameter representing the performance is the mass resolving power. Improvement of both of them is an important factor not only for improving the analyzing sensitivity and the analyzing reliability in the current application use, but also for creating new application. One of the methods of further improving the detection sensitivity is to produce a larger amount of specimen ions by improving the efficiency of ionizing and effectively introducing them into the ion trap, thus accumulating more ions in the ion trap.

However, the Paul trap has an upper limit for the number of ions that can be trapped. This is caused by the effect that the trapped ions exert coulomb force to each other when a number of ions are introduced, that is, the mass resolving power is lowered by the space-charge effect. That is, there is an upper limit for the number of ions that can be accumulated while keeping a high mass resolving power. Then, a method of trapping more ions without lowering the mass resolving power has been proposed and put to practical use. This is a method of using an ion trap of a radio frequency quadrupole linear electrode structure (hereinafter referred to as a linear ion trap) instead of the Paul trap. This method was proposed in "Storage-Ring Ion Trap Derived from the Linear Quadrupole Radio-Frequency Mass Filter", Journal of Applied Physics, vol. 40, p.3127 (1969), D. A. Church (literature 5). The electrode structure used in this method is a ring-shaped linear ion trap. Further, a similar ring-shaped radio frequency quadrupole linear ion trap for accumulating the ion beam was proposed in "Antihydrogen Production by Positronium-Antiproton Collisions in an Ion Trap" Physica Scripta, vol. T22 p.248 (1988), B. I. Deutch et al (literature 6). Further, a mass spectrometry method using a linear ion trapping electrode structure of a linear shape was disclosed by J. E. P. Syka et al in U.S. Pat. No. 4,755,670 (literature 7).

In the following, explanation will be made to the electrode structure of the quadrupole linear ion trap and the principle of ion accumulation. The electrode structure is identical with that of the quadrupole mass filter, in which four rod electrodes are disposed in parallel and such that the relative positions of the electrodes are in a square configuration in cross section. Generally, the surface for each of the electrodes is formed to provide a hyperbola in cross section. A radio frequency voltage is applied between two sets of electrode groups, where each set comprises two electrodes situated at facing corners of the square electrode configuration. As a result, a quadrupole radio frequency electric field is formed inside the electrodes. In the same manner as in the 3DQ ion trap, when a radio frequency electric field is applied under the condition of stable trapping of ions, ions can be trapped in the directions perpendicular to the center axis of the electrode structure. This stabilization is described by the following two parameters a and q.

$$a=4eU_{dc}/(m\Omega^2 r_0^2) \quad (1)$$

$$q=2eU_{ac}/(m\Omega^2 r_0^2) \quad (2)$$

in which m and e represent, respectively, the mass and charge of the ion, $U_{ac}$ and $\Omega$ represent, respectively, the interelectrode amplitude and angular frequency of the quadrupole radio frequency voltage, $U_{dc}$ represents a quadrupole static voltage and $r_0$ represents a distance between the central axis of the electrode structure and the electrode surface. If the two parameters are present in a stable region of a Mathieu equation, ions can be trapped stably. In the case of the linear ion trap, if the static voltage $U_{dc}$ is set to 0, the stable conditions can be described with the parameter q as follows. A stable region including (a, q)=(0, 0), which can be utilized easily in the linear ion trap, is given by the following equation 3:

$$q<0.908 \quad (3)$$

Further, the potential formed by the radio frequency electric field for trapping the ions is referred to as a pseudo-harmonic potential and the depth thereof is given by the following equation 4:

$$D\ 32\ qU_{ac}/8 \quad (4)$$

On the other hand, in the linear ion trapping electrode structure, it is necessary to trap the ions in the directions of the central axis of the electrode structure while trapping the ions in the direction perpendicular to the central axis. There are two methods to accomplish this purpose. One of them is a method of making the electrode into a ring-shape to eliminate both ends of the linear electrode structure as shown in literature 5 and literature 6. Another method is to additionally provide a means capable of applying a static electric voltage to both ends of the electrode structure thereby forming a potential wall. This means is hereinafter referred to as end electrodes.

By using the linear ion trap as described above, the amount of ions capable of being accumulated can be increased. This is achieved by increasing the length of the liner electrode structure, which results in an increase of the volume of the ion trap. Such an increase of the trap length is easily possible because the parameters for ion trapping conditions do not change.

This is not the case for Paul trap, because increased volume results in the change of $r_0$, and this a change of trap parameter. With increased volume of the liner ion trap, the ion density become lower, resulting in reduced space charge effect. Because of the liner geometry, space-charge effect is reduced in linear trap compared to Paul trap that have the same volume. Thus, using the linear ion trap instead of a Paul trap, more ions can be trapped without lowering the mass resolving power.

The literature 7 discloses a method of conducting mass spectrometry by measuring the frequency of secular oscillatory motion by measuring a current induced to the linear ion trapping electrode when ions kept inside the linear ion trap described above oscillate with the secular frequency. However, as pointed out also in the literature 7, the mass resolving power is lowered by the effect of the end electrode voltage applied on both ends of the linear electrode structure. This is attributable to the positional dependence of the secular frequency in the direction of the central axes caused by intrusion of the static electric voltage to the linear ion trap region. In the method of measuring the induced current, as adopted in the literature 7, deviation of the secular frequency in the direction of the central axes directly leads to the deterioration of the mass resolving power.

One of known methods proposed as a countermeasure for the problem of the lowering in the resolving power caused by the end electrode voltage is a method of sectioning the linear electrodes into a plurality of portions, so that they are aligned in the direction along the central axis, and gradually applying an electric field gradient of the static voltage to each of the portions, which is described in literature 7. However, drawbacks may be pointed out also to this method. That is, a high fabrication accuracy is demanded to the linear quadrupole electrode structure for obtaining the required mass resolving power. Further, literature 7 shows another method of forming a potential for trapping ions in the direction of the central axis by coating a resistor material on the surface of the electrodes thereby attaining the same effect as that of the end electrode. However, in the linear ion trapping electrode, a radio frequency voltage should be applied in addition to the static voltage. Since it is not possible to provide a low impedance to the radio frequency while a high impedance to the static voltage by the method of coating a resistor material, the method is difficult to practice. That is, it is not desirable to perform mass spectrometry at high resolving power and high sensitivity by the method shown in the literature 7.

On the other hand, in a case of using the ring-shaped linear ion trap, since no end electrode is required, the mass resolving power is not lowered by the end electrode.

Descriptions for conducting mass spectrometry operations in the ring-shaped linear ion trap are found in "Observation of Ordered Structures of Laser-Cooled Ions in a Quadrupole Storage Ring," Physical Review Letters, vol. 68, p. 2007 (1992), I. Waki et al (literature 8). That is, for increasing the concentration of magnesium ions having mass of 24 trapped in the ion trap, unnecessary ions such as residual gas ions having mass of 25 or greater are ejected by mass selection in the direction perpendicular to the central axis to the outside of a ring-shape linear ion trapping electrode structure by a mass selective instability operation and they are detected by an ion detector.

Further, a method of a mass spectrometric operation by using a ring-shaped linear ion trap is disclosed by M. E. Bier, et al in U.S. Pat. No. 5,420,425 (literature 9). This literature proposes a method of using a ring-shaped ion trapping electrode for practicing the mass selective instability operation mode or the mass selective resonance ejection operation mode practiced so far in the Paul trap. In this method, ions are taken out perpendicular to the central axis of the linear ion trapping electrode structure from a gap of the electrode structure or an ion take-out hole perforated to the ion trap electrodes.

However, since the ring-shaped ion trapping electrode has a curvature, this results in the lowering of the mass resolving power, so that it is difficult to obtain a high mass resolving power.

Literature 9 also proposes a mass spectrometric method by the mass selective instability operation mode or the mass selective resonance ejection operation mode also for the linear ion trap of a linear shape in addition to the ring-shaped ion trapping electrode. However, a method of effectively eliminating the undesired effect of the end electrodes is not disclosed.

SUMMARY OF THE INVENTION

In summary, for using the linear ion trap structure for a mass spectrometer having high sensitivity and high resolving power, it is desired for such an electrode structure of a linear shape to be adapted for effectively eliminating the undesired effect of the end electrodes. The undesired effects given by the end electrode regarding several ion detection principles are summarized as below.

As for the method of ejecting ions to the outside of the ion trapping electrode structure and detecting them, as in the Literatures 5 and 6, values for the two parameters shown in the equation 1 and the equation 2 are not constant on the central axis but have positional dependence due to the end electrode. In view of the above, upon mass spectrometric scanning, ions of the same mass-to-charge ratio are ejected at different timings. This apparently lowers the mass resolving power.

Further, as for the method of detecting ions in the trap in-situ, such as, a method of measuring a current induced by the ions to the linear ion trapping electrode as shown in literature 7, or a method of detecting the oscillations of the secular frequency of the ions by an optical means described in literature 4, the secular frequency of the same ion species shows positional dependence along the central axis of the electrode structure depending on the static voltage applied to the end electrodes. This causes lowering of the mass resolving power.

In view of the above, it is an object of the present invention to provide effective methods of eliminating undesired effects of a static voltage applied to end electrodes and attain mass spectrometry at high resolving power, as well as an operation method thereof in the mass spectrometry using a linear ion trap.

For dissolving the foregoing problems, the present invention provides means for realizing an apparatus structure substantially free from the effect of the end electrodes in the stage of analysis.

DETAILED DESCRIPTION

Figure 1A:
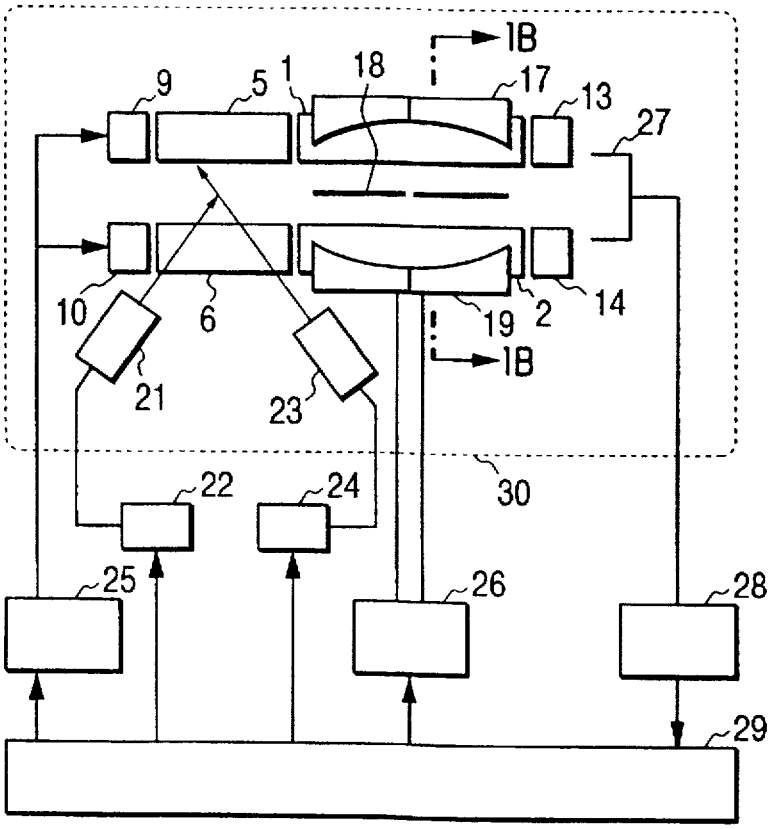
FIG. 1A is a block diagram for the entire constitution of a preferred embodiment of a concave planar electrode structure according to the present invention in a bisected view taken along an arrow at a position 1A—1A in FIG. 1B.

First, an example of an ion trap mass spectrometry apparatus adapted to extract ions under selection of mass from an end portion of a linear ion trap electrode structure is disclosed.

The principle of the mass spectrometry apparatus is explained in the following. In this example, as in the case of conventional linear ion traps, it is necessary that ions are not accidentally lost from the end of the linear electrode structure. However, the present means for this purpose does not entirely rely on the end electrodes but relies on a harmonic or approximately harmonic potential formed in the direction of the central axis of the linear ion trap electrodes. Ions are trapped by the potential in the direction of the central axis. For mass spectrometric operation, a harmonic static potential along the central axis is used. That is, the trapped ions have harmonic oscillation mode whose frequency depends on the mass-to-charge ratio. If the frequency of harmonic oscillations can be determined, it is possible to know the mass-to-charge ratio of the ions. The actual mass spectrometric operation is conducted by applying an auxiliary alternating electric field to excite harmonic oscillations of ions in the harmonic potential along the central axis. Ions whose secular frequency coincides with the alternating electric field frequency start to oscillate resonantly and the amplitude of the oscillation increases with time. That is, the kinetic energy of the ions is increased. Then, when the energy is increased to higher than the depth of the harmonic potential along the central axis, the ions are ejected from the end portion of the linear trap electrodes. The ions are detected by a particle detector. For obtaining the mass spectrum, the mass-to-charge ratio of the trapped ions and the number of the ejected ions corresponding thereto are measured by measuring the amount of the ejected ions while scanning the depth of the harmonic potential, thereby changing the resonant frequency, with fixed frequency of the auxiliary external resonant alternating electric field. Alternatively, the mass-to-charge ratio of the trapped ions and the number of ions corresponding thereto are measured by measuring the amount of the ejected ions while scanning the frequency of oscillations of the auxiliary external resonance electric field while fixing the depth of the harmonic potential.

Further, this embodiment has another feature. Since the ions are ejected from ends of the linear electrode structure, when the ions are ejected by the mass spectrometric operation, there is no electrode structure for physically hindering the ejection of the ions. Thus, the ions are not lost by collision against the electrode structure. In addition, since the linear quadrupole trap has a focusing effect of directing the ions to the central axis, collision of the resonated ions against the linear electrode structure can be avoided. As described above, an extraction efficiency upon ejecting the ions can be increased. That is, the detection sensitivity can be improved.

Next, methods of forming static electric field harmonic potential in the direction along the central axis and methods of applying an alternating voltage for resonating the ions are disclosed. For the sake of convenience, the two methods are explained separately. In the practice of the present invention, however, both methods can be combined. The linear ion trap is a general name of ion traps having an electrode structure in which even number of linear electrodes are arranged by four or more effectively in parallel. In the embodiment to be described later, an ion trap of a structure comprising of linear electrodes, that is, a quadrupole linear ion trap is shown as a typical example. However, the present invention is applicable as it is to a case of a multi-pole ion trap having a greater number of electrodes. Since the linear electrode structure gives only the effect of focusing the ions toward the central axis, as apparent from the principle of the present invention, the analysis method does not depend on the configuration of the ion trap potential formed by the multi-pole ion trap. Further, in the subsequent explanation, the charge of the trapped ions is assumed as a positive charge for the sake of convenience. In a case where negatively charged ions are targets for the analysis, the polarity of the static voltage may be inverted appropriately.

Several means for forming the static field harmonic potential on the central axis are disclosed in the following.

Figure 7A:
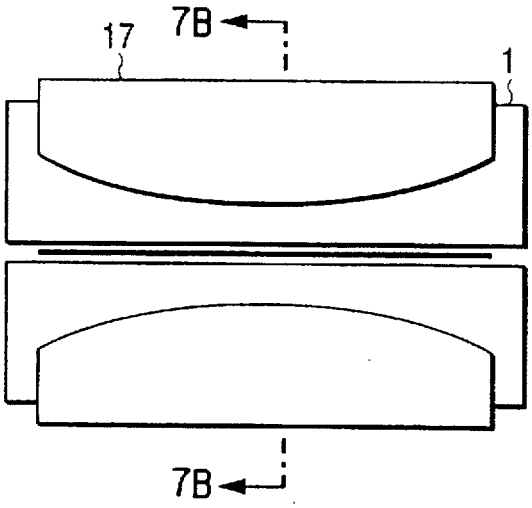
FIG. 7A is a diagram for explaining one of relationships between a planar electrode and a linear ion trapping electrode structure adoptable in the present invention, in a cross-sectional view taken along an arrow at a position 7A—7A in FIG. 7B.
Figure 8A:
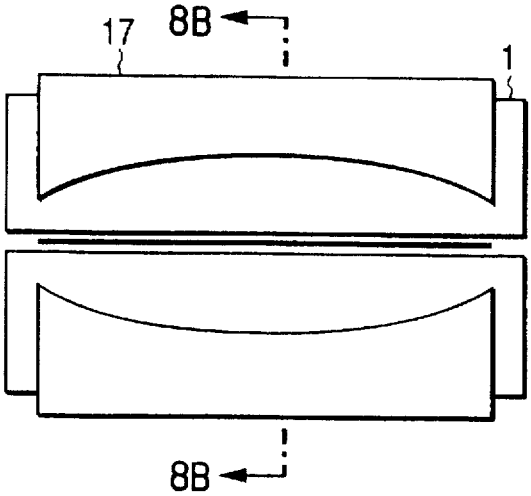
FIG. 8A is a diagram for explaining one of relationships between another planar electrode and a linear ion trapping electrode structure adoptable in the present invention, in a cross-sectional view taken along an arrow at a position 8A—8A in FIG. 8B.

In a case of a quadrupole linear ion trap electrode structure, there are, in total, four electrode gaps formed between each of adjacent electrode structures. A planar electrode can be inserted into a gap formed by each of the electrodes (the reference numeral is only attached to the electrode 1 as an example; refer to FIGS. 7A, B). The shape of the planar electrode 17 facing the ion trap axis is made into a semi-circular shape. The electrode is inserted into at least one of four electrode gaps such that an arcuate side directs to the central axis and does not intersect the central axis. If a negative voltage is applied to the electrode structure by the planar electrode 17, positive charged ions can be attracted to the center of the trap electrodes, and confined. Alternatively, the shape of the planar electrode 17 facing the side of the ion trap center axis is made into an arcuately concave shape (refer to FIGS. 8A, B). The planar electrode 17 is inserted into at least one of the four electrode gaps such that the arcuate side faces the central axis and does not intersect the central axis. It is of course ideal that the planar electrode 17 is inserted into all of the electrode gaps and each of the embodiments is shown as such. If a positive voltage is applied to the electrode structure by this planar electrode 17, positive charged ions can be attracted to near the longitudinal center of the central axis of the trap electrodes in the same manner. Single electrode 17 may be suffice for the present purpose since the electrode is used to form a static harmonic potential on the central axis, and the quadrupole linear ion trapping electrode structure gives an effect of collecting the ions toward the central axis. That is the electrode 17 does not necessarily be symmetrical with respect to the central axis.

A potential for trapping the ions in the axial direction can be formed by using the electrode structure described above and a DC voltage source for giving a potential to the electrode structure. The shape of the electrode should be determined so that the potential is made harmonic or approximately harmonic along the central axis of the electrode. Numerical analysis by a computer is effective for determining the electrode shape.

Figure 9A:
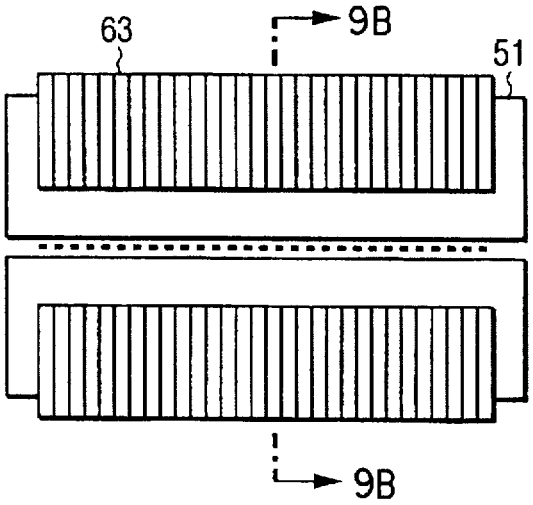
FIG. 9A is a diagram for explaining one of relationships between a further planar electrode and a linear ion trapping electrode structure adoptable in the present invention, in a cross-sectional view taken along an arrow at a position 9A—9A in FIG. 9B.
Figure 9B:
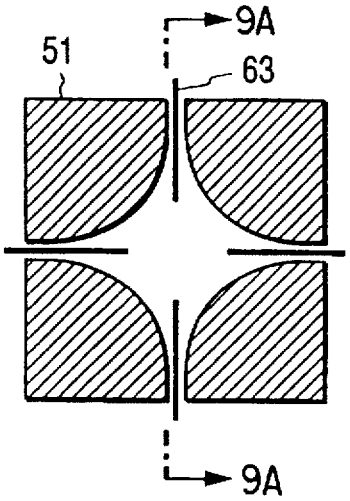
FIG. 9B is a cross-sectional view for an electrode portion taken along an arrow at a position 9B—9B in FIG. 9A.

Another method of forming a harmonic potential on the central axis is shown (refer to FIGS. 9A and 9B). As a planar electrode structure 63 to be inserted into the gaps of a linear electrode structure (only electrode 51 is shown as a typical example), a plurality of narrow width rectangular electrodes are arranged in an array such that the outer profile of the arrangement constitutes a rectangular planar plate. The rectangular electrodes are insulated with respect to one another. A static voltage is applied appropriately to each of the rectangular electrodes to form a harmonic potential along the central axis. Particularly, in a case of arranging each of the rectangular electrodes practically in an equal width and at an equi-distance, if the distribution of the voltage applied to each of the rectangular electrodes is in a relationship of a quadratic function, the potential formed on the central axis is an approximately harmonic potential. According to this example, there is no requirement for complicate numerical calculation for determining the electrode shape. The desired static voltage on the group of rectangular electrodes can be obtained as follows, for example. A rectangular electrode situating at the center of arranged rectangular electrodes is grounded to the earth. Adjacent rectangular electrodes are connected with an appropriate resistor such that a predetermined voltage is applied to each of the rectangular electrodes where a static voltage is applied on both ends thereof. The width and shape of the rectangular electrodes does not necessarily need to be identical as long as an approximately harmonic potential is realized along the central axis.

Figure 10A:
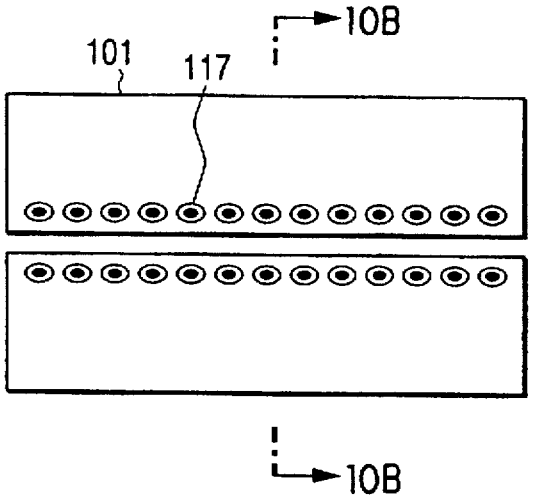
FIG. 10A is a diagram for explaining one of relationships between buried electrodes and a linear ion trapping electrode structure adoptable in the present invention, in a cross-sectional view taken along an arrow at a position 10A—10A in FIG. 10B.
Figure 10B:
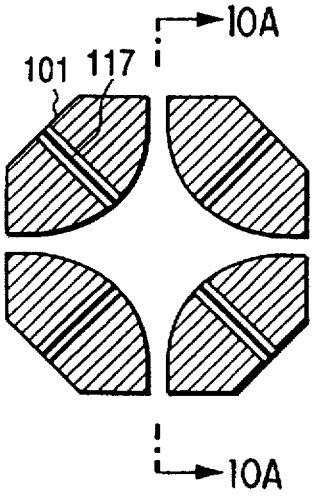
FIG. 10B is a cross-sectional view of an electrode portion taken along an arrow at a position 10B—10B in FIG. 10A.

Further, another method of forming a harmonic potential on the central axis is shown (refer to FIGS. 10A, 10B). In this method, a row of electrostatically insulated fine rod electrodes 117 are buried so that the electrode surface is exposed in a line on the surface of the linear electrodes facing the central axis of the linear ion trapping electrode structure (only the electrode 101 is indicated as a typical example). The rows of the electrodes 117 is desirably short-circuitted with the linear electrode 101 with respect to the radio frequency. Appropriate static voltages are applied to the plurality of buried electrodes to prepare an approximately harmonic potential along the central axis. Particularly, an approximately harmonic potential can be formed easily on the central axis, if the electrodes are buried at an equal distance, and, in addition, if a quadratic relationship is formed for the potential applied to each of the electrodes by division with appropriate resistors. As pointed out in the previous embodiment, however, the width and the distance of the electrodes in the electrode rows does not need to be identical so long as they can prepare an approximately harmonic potential on the central axis.

Figure 11A:
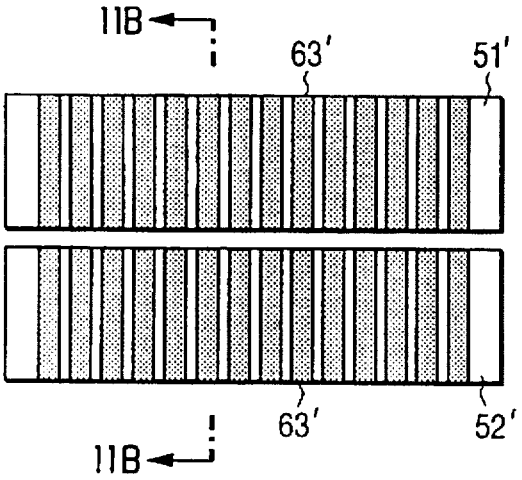
FIG. 11A is a cross-sectional view for explaining an example of a relationship between an example of a film electrode instead of the planar electrode or the buried electrode and the linear ion trapping electrode structure adoptable in the present invention.
Figure 11B:
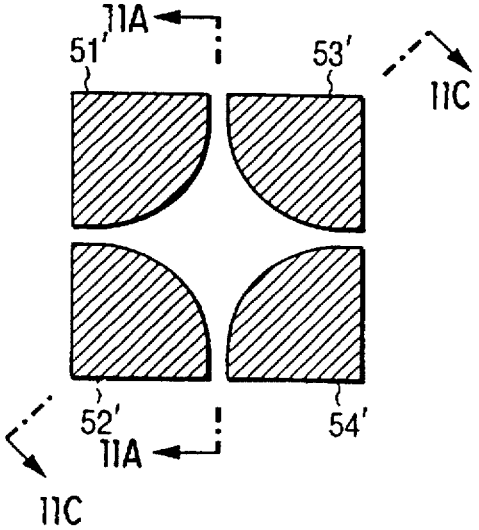
FIG. 11B is a cross-sectional view for an electrode portion taken along an arrow at a position 11B—11B in FIG. 11A.
Figure 11C:
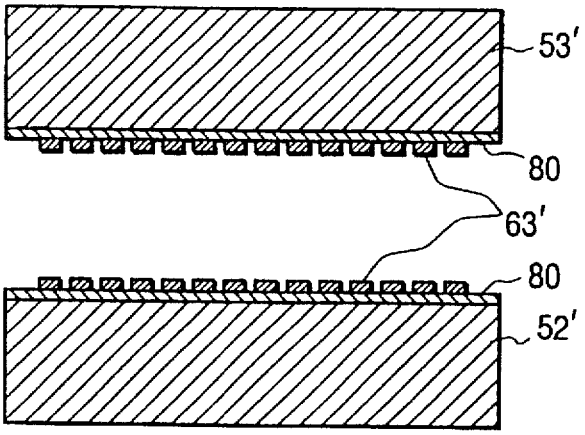
FIG. 11C is a cross-sectional view for an electrode portion taken along an arrow at a position 11C—11C in FIG. 11B.

A further method of forming a harmonic potential on the central axis is shown (refer to FIGS. 11A, 11B and 11C). In this method, islands of thin electrode film, insulated electrostatically from the linear electrode, is coated (or attached) to the surface of the linear electrode in a line on the surface facing the central axis of the linear ion trapping electrode structure. It is desirable that the islands of the electrode film is short-circuited with the linear electrode with respect to the radio frequency. An approximately harmonic potential is prepared on the central axis by arranging the electrode film into an appropriate configuration as in the previous examples where an appropriate static voltage is applied, or by appropriately dividing the electrode film where an appropriate static voltages are applied to a plurality of the islands of electrode film.

For effectively operating the electrode structure to prepare the harmonic potential, it is preferred to adopt a method of applying a radio frequency to the linear ion trap electrodes such that the radio frequency is always at a grounded potential on the central axis. This results in a grounded potential on equi-distance surface between adjacent constituent linear electrodes of the linear ion trap. When the auxiliary electrodes for forming harmonic potential is inserted on the equi-distance surface between the linear electrodes, deformation of the radio frequency electric field by the insertion of the auxiliary electrodes can be eliminated.

A method of applying an alternating voltage to excite the oscillation of the stored ions is disclosed below.

In a case of a structure for preparing a electrostatic harmonic potential by convex or concave planar electrodes as described in the previous embodiments, each planar electrode is further divided into plurality between which an alternating voltage is superposed. The simplest method is to bisect the planar electrode to which an alternating voltage is superposed.

Figure 7B:
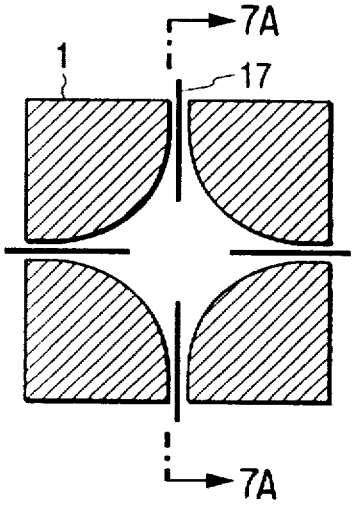
FIG. 7B is a cross-sectional view for an electrode portion taken along an arrow at a position 7B—7B in FIG. 7A.
Figure 8B:
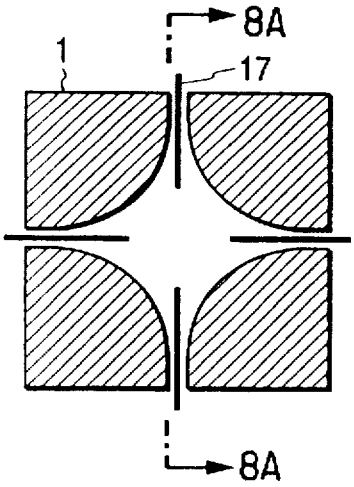
FIG. 8B is a cross-sectional view for an electrode portion taken along an arrow at a position 8B—8B in FIG. 8A.

A shortcoming of simple bisectioning is that the accelerating field, with which the ions resonate, is limited to the region near the gap of the two bisected electrodes. This inefficiency can be avoided if one can apply such an alternating voltage that the ions will be accelerated (or heated) over the entire region where a harmonic or approximately electrostatic harmonic potential is applied. In this way, the amplitude of the oscillation can be increased much faster than in a case of bisecting the electrode. To achieve this, instead of bisecting the convex or concave type planar electrodes shown in FIG. 7 and FIG. 8, one could use, for example, an electrode structure formed by combining a number of small electrodes as shown in FIG. 9. Here, adjacent small electrodes are connected by resistors, where an alternating voltage is applied between the small electrodes on both ends. The small electrodes may be inserted between the linear quadrupole electrodes as depicted in FIG. 9. Or, they can be buried electrodes as shown in FIG. 10. Or, the small electrodes may be coated films as shown in FIG. 11. For all these possible configurations, the small electrodes are connected to their adjacent ones with suitable resistor material so that a desired electrostatic harmonic potential is approximately formed along the trap axis. Concrete examples of the mass spectrometric means for extracting ions mass-selectively from the end section of the linear ion trapping electrode structure are shown in the following Embodiments 1 to 4.

Next, we give an example of a mass spectrometry apparatus for extracting ions in a direction perpendicular to the central axis of the linear ion trapping electrode structure. As already explained, such an extraction method has a disadvantage that the mass resolving power is lower due to the effect of end-electrodes. To avoid this, we shield the ions that are elected mass-selectively from the vicinity of the end electrodes, so that they will not reach the ion detection means. A longer length of a shielding section near the end electrode is preferable for better mass resolving power. Longer shielding length, however, will result in a lower yield of the detected ions, lowering the detection sensitivity. Thus, one should optimize the length of the shielding section in accordance with the desired mass resolving power and the desired sensitivity.

To estimate the optimized length, we give a simple model below. The undesirable effect of the static voltage applied to the end electrodes on the ion-trapping potential can be approximated as being equivalent to the shallowing of the depth of the ion trap potential in the vicinity of the end electrodes. We first assume a pseudo-harmonic potential for the shape of the trapping potential in the plane perpendicular to the trap axis. We further assume that the positional dependence of the depth of the pseudo-harmonic potential D in the direction of the central axis is described by $D=D_0-\phi(z)$, where $D_0$ is the depth of the pseudo-potential prepared by the radio frequency electric field in the absence of the end electrodes, $\phi(z)$ is a static potential on the central axis by the static potential of the static voltage applied to the end electrodes, and z is the coordinate along the linear trap axis.

Since the exact calculation for $\phi(z)$ is difficult, we estimate $\phi(z)$ using a simplified model and shape of the electrode surface as shown below. The shape of the linear ion trapping electrodes and the end electrodes are approximated by cylinders. The potential-depth change $\phi(z)$ along the central axis is calculated as follows. A pair of a linear trapping electrode and an end electrode, having the same radii, are represented by two metal cylinders which are aligned coaxially separated by a negligibly small gap, each having infinite length on the side not facing each other. $\phi(z)$ is given by the equation 5.

$$\phi(z)=Ve^{-2\lambda}/(e^{-2\lambda}+1)$$

$$\lambda=1.318z/r_0 \tag{5}$$

where $r_0$ is the radius of the electrodes, V is the potential difference between the two electrodes, and z is the coordinate along the central axis whose origin is at the gap position.

Equation (5) is described in the literature 10, written by M. Szilogyi "Electron and Ion Optics", Plenum Press (1988), from page 72 to 75. Particularly, if z is sufficiently large (away in the positive direction from the origin at the gap z=0), Equation (5) is approximately given by the following Equation (6).

$$\phi(z)=Ve^{-2\lambda} \tag{6}$$

The frequency ω of harmonic oscillation of charged particles having mass m and electric charge e trapped inside a harmonic potential, in which the potential depth at radius $r_0$ is D, is given by the following Equation (7).

$$\omega^2=2eD/(mr_0) \tag{7}$$

As shown in the Equation (7), the depth D of the pseudo-harmonic potential is proportional to the mass m, assuming that ω and $r_0$ are constant. Then, the relationship between the minute change for the depth of the pseudo-harmonic potential $\Delta D=\phi(z)$ and the mass resolving power Δm/m is given by the following equation 8.

$$\Delta m/m=\Delta D/D=\phi(z)/D_0 \tag{8}$$

Using Equations (6) and (8), the error in the mass determination Δm/m is given as a function of the position z by the following Equation (9), for $z>r_0$.

$$\Delta m/m=(V/D_0)exp(-2.636z/r_0) \tag{9}$$

Therefore, one can use Equation (9) to determine the shielding length that is required to obtain a desired mass resolution.

In the foregoing calculation, the ion trap potential is approximated by a pseudo-harmonic potential. This approximation is valid only when the stability parameter q is small (smaller than about 0.3). In a case this approximation is not valid, the degradation of mass resolution due to the field deformation by the end electrodes must be evaluated using a computer simulation of the Mathieu equation.

We now consider an example of a shielding of the ejected ions, where the ejecting direction of the ions is toward a surface of a linear electrode, and the ions are extracted to the outside of the trap through holes of the electrode. In this case, the shielding is achieved by perforating the extraction holes on the electrode surface away from the vicinity of the end electrode. The length to avoid the opening is determined using Equation (9).

Another example of shielding is to use a shield plate, which is positioned outside of the linear ion trapping electrode structure so as to inhibit the ions ejected from the vicinity of the end electrodes from reaching the ion detector.

Similarly, shielding plates outside the trap electrode structure are effective to shield off the ions from reaching the detector in the case when the ions are ejected perpendicular to the linear trap axis from a gap between the linear ion trapping electrodes. This embodiment is described in Embodiment 5, and shown in FIG. 13.

Now, we will describe how to apply our invention to a mass spectrometry apparatus that uses optical means, in which ions are kept inside the ion trap even after mass analysis (in situ analysis) as described in the Literature 4. In this case, we shield an optical path so that the light emitted from the vicinity of the end electrode, which lowers the mass resolving power, from reaching the light detector. The light shield should be so prepared as not to shield any light emitted from a region near the longitudinal center of the linear electrode where the effect of the end electrode is negligible. The length of the light shield can again be determined by substituting a desired value of mass-resolution into Equation (9). This example is shown in Embodiment 6.

Another method of improving the resolving power in a case of the mass spectrometry by an optical means is to limit the area of irradiation of the light to excite the fluorescence of ions. To this purpose, irradiation should be limited to the vicinity of the longitudinal center of the linear ion trapping electrode structure while avoiding the vicinity of the end electrode. The extent of the irradiation can be determined by substituting a desired value of mass-resolution into Equation (9).

EMBODIMENT 1

(Embodiment of bisected concave planar electrodes)

Figure 1B:
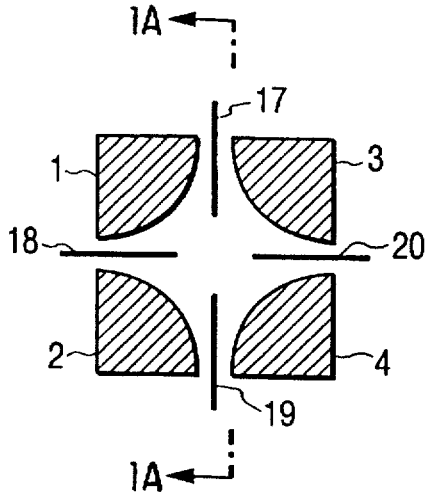
FIG. 1B. is a cross-sectional view of an electrode portion taken along an arrow at a position 1B—1B in FIG. 1.
Figure 2A:
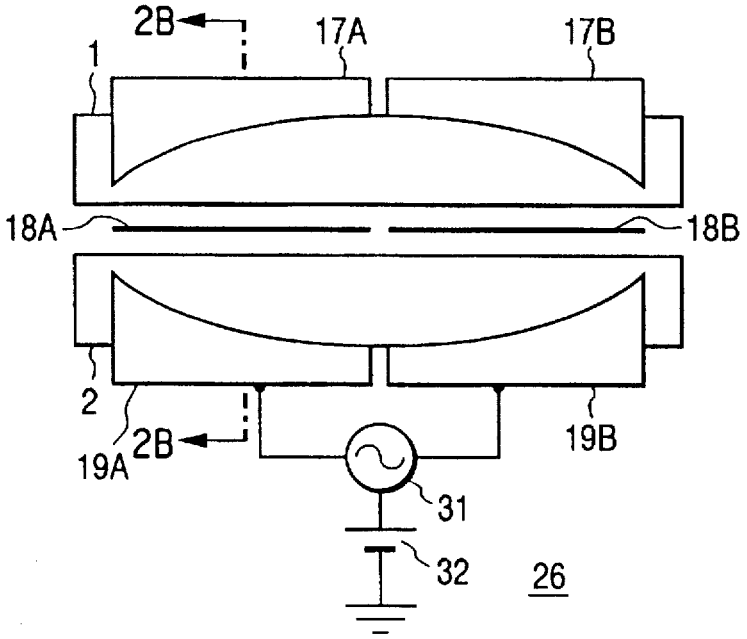
FIG. 2A is a block diagram for a detailed constitution of a mass spectrometric section of the embodiment shown in FIG. 1 in a cross-sectional view taken along an arrow at a position 2A—2A in FIG. 2B.
Figure 2B:
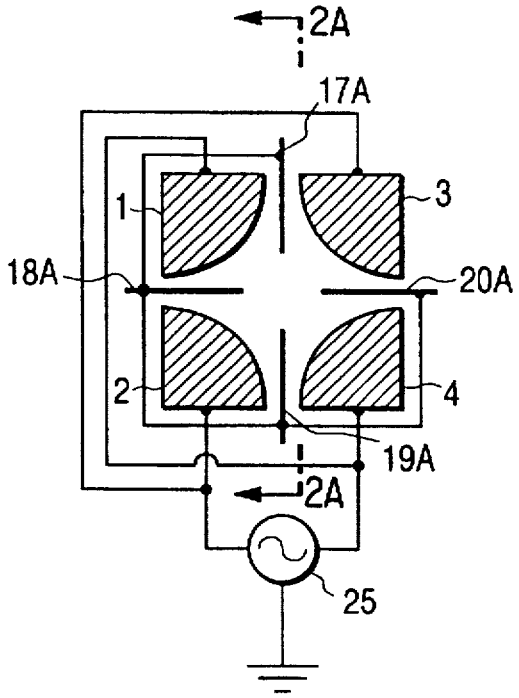
FIG. 2B is a cross-sectional view of an electrode portion taken along an arrow at a position 2B—2B in FIG. 2A and a constitution of an electric circuit.

An example of using a bisected concave planar electrode is described as Embodiment 1 with reference to FIG. 1 and FIG. 2. Embodiment 1 is a simple example of a linear ion trapping mass spectrometry apparatus where ions are extracted in the direction along the central axis. This apparatus attains the mass spectrometric function by trapping ions in the direction along the central axis by the bisected concave planar electrodes 17, 18, 19 and 20, which are inserted between the gaps between the linear trap electrodes 1, 2, 3 and 4. FIG. 1B and FIG. 2B show a cross sectional structure of a linear ion trapping mass spectrometric section, with the four linear trap electrodes and four planar electrodes in the linear ion trapping mass spectrometric section.

Specimens can be either residual gases present in the gas chamber or specimens introduced into the chamber after being pre-processed by a separator apparatus, such as a gas chromatography apparatus or a liquid chromatography apparatus. The specimens are ionized in an ion source section and introduced to the linear ion trapping mass spectrometric section. As for the ionization, one can use any popular means such as electron impact ionization, chemical ionization, electrospray ionization, thermospray ionization, field ionization, field desorption, fast atom bombardment, laser ionization, or atmospheric pressure ionization methods. This specific embodiment shows an example of an electron impact ionization using an electron beam.

The reason of isolating the ion source section and the linear ion trapping mass spectrometric section is to avoid contamination of the mass analysis section due to deposition of specimen molecules and their derivatives on the linear trapping electrodes.

First, we shall describe the linear ion trapping mass spectrometric section of this Embodiment 1. The linear ion trapping mass spectrometric section comprises a structure in which four electrode rods 1–4 are arranged in parallel relative to the central axis and the relative positions of the respective electrodes form a square shape within a plane vertical to the central axis. A portion of the cross sectional shape facing the central axis is prepared as a hyperbolic surface or an approximately hyperbolic surface. The distance, $r_0$, from the central axis to the nearest surface is desirably between 2.5 mm and 10 mm. In this embodiment, the distance is 5 mm. The length, L, of the electrode rods 1–4 must be larger than $r_0$, so that the undesirable effect of the end electrodes is minimized. L is 50 mm in this embodiment.

In this embodiment, trapped ions are mass-analyzed using four planar electrodes 17–20, inserted between the linear trap electrodes. Each planar electrode has an arcuately concave surface, and is bisected. That is, there are eight planar electrodes in total. The shape of the electrode surface must be optimized in accordance with the shape of the linear ion trapping electrode structure. For this purpose, it is desirable to determine the optimal shape with simulation of the static electric field using a computer. That is, the shape of the planar electrodes should be determined as follows; a desired harmonic potential should be formed along the central axis, when all the four linear quadrupole trap electrodes are put to the ground potential and a static voltage is applied to the four planar electrodes. The gap between the bisected parts should be less than 1 mm, so that undesired effect of the deformation of the static voltage caused by the gap is minimized. To apply analyzing voltages to the eight planar electrodes, the 8 electrodes are grouped into two sets, each comprising four planar electrodes. A set comprises four electrodes, that are situated in the same position regarding the coordinate along the trap axis. The four electrodes of a set are short-circuited, and thus are kept at the same electric potential, with respect to each other. For mass analysis, an alternating voltage 31 is applied between the two sets of electrodes, while both sets are kept in the same electrostatic voltage 32. The alternating voltage excites the secular oscillation of the ions in the electrostatic harmonic potential formed by the concave planar electrodes. The two voltage sources are represented by a reference numeral 26 in FIG. 1A. An example of a practical embodiment for applying the voltage is shown in PCT/JP95/01322 (refer to WO97/02591 if necessary), which is a prior patent application by the present applicant.

Next, we shall describe the ion source section of this Embodiment 1. The electrode structure of the ion source section is a linear quadrupole electrode structure with a cross sectional shape identical with that of the linear ion trapping section and comprises electrodes 5, 6, 7 and 8, where electrodes 7 and 8 are not illustrated in FIG. 1A. The length should be sufficiently larger than $r_0$; the length is 30 mm in this embodiment. The portion comprises a specimen source 23 and an electron source 21. The specimen source 23 atomizes gas or liquid containing specimen preprocessed by a pretreatment device such as gas chromatography apparatus or liquid chromatography apparatus, which separates various components of specimen according to their molecular size. The atomized specimen can be emitted from the specimen source either continuously or intermittently. In FIG. 1A, the specimen pretreatment device, the specimen introduction device and a driving device are collectively shown as 24. The electron source 21 accelerates thermal electrons emitted from a heated filament to generate an electron beam. The acceleration voltage is about 100 V. In FIG. 1A, power sources for driving the electron source 21 are collectively shown as 22. The electron beam is switched on or off by the on-off of the acceleration voltage. The specimen gas from the specimen source 23 and electron beam from the electron source 21 are directed into the inside of the ion source section of the quadrupole electrode structure comprising electrodes 5, 6, 7, and 8. There, the electron beam bombards and ionize specimen molecules. By controlling the irradiation time of the electron beams, the amount of specimen ions to be produced can be adjusted.

End electrodes 9, 10 and 13, 14 (only four of the end electrodes out of a total of eight end electrodes are shown in FIG. 1A) are disposed further to confine the ions axially. Four end electrodes form an end electrode section, resulting in two sets of end electrode sections. An end electrode section is disposed to each of both ends of the colinearly aligned set of the linear electrodes of the ion source section and the ion trapping section. All the linearly-aligned four sections of the apparatus—i.e., the two end electrode sections, the ion source section and the ion trapping section—have linear quadrupole electrode structures whose cross-sectional shapes are identical to one another. The length of the end electrode section should be greater than $r_0$, so as to effectively confine the ions. The length is 10 mm in this embodiment.

The ion detector 27 is disposed colinearly on the center axis facing the end electrode section of the linear quadrupole electrode structure. The ions ejected during mass analysis are detected by the ion detector 27 and ion-counting system 28. Since the ions are ejected to both sides of the ion trapping mass spectrometric section during mass analysis in this embodiment, it is desirable to detect the ions ejected from both ends by disposing ion detectors (with the same capability as the ion detector 27) on both ends. It is also possible, however, to arrange the ions to be ejected only on one side by adjusting the potential of the end electrode sections. In this case, one needs only one ion detector.

The foregoing quadrupole electrode structures, the electron source, the specimen source and the ion detector are all disposed inside a vacuum vessel 30. Helium gas may be introduced into the vacuum vessel to cool the ions by collision. The pressure of helium gas is optimized between $10^{-6}$ Torr and 1 Torr.

For trapping the ions in the direction perpendicular to the central axis, the power source 25 provides the radio frequency voltage to all the quadrupole electrode structures: i.e., the ion trapping mass spectrometric section, the ion source section and the end electrode sections. For electrical wiring to produce a quadrupole field, all the electrodes are grouped in pairs. Each pair comprises two electrodes that face each other across the center axis of the linear quadrupole structure. A quadrupole section comprises two pairs of thus grouped electrodes. In each pair, radio frequency voltages of an identical phase and amplitude are applied to the two electrodes. The two pairs in each quadrupole section are supplied with radio frequency voltages that are identical in the amplitude but 180 degrees out of phase to each other. An example of wiring for this purpose is shown in PCT/JP95/01322 (refer to WO97/02591 if necessary) which is a prior patent application of the present applicant.

The amplitude of the radio-frequency voltage is determined so as to satisfy the stability conditions of the trapped ions shown in the Equation 2 and the Equation 3. The applied radio frequency voltage is so prepared that the radio frequency potential is equal to the ground potential along the central axis of the quadrupole electrode structure. For example, this is achieved by applying radio frequency voltages having identical amplitudes but phases different by 180 degrees between the electrode pairs in each quadrupole section.

To control confinement of ions in the quadrupole sections, a static electric voltage is supplied to all the electrodes of each of the four quadrupole sections. The voltages for each sections is independently adjusted so as to optimize the ion translation between the sections. This can be attained by wiring the linear electrodes to variable DC voltage power sources by way of resistors of about mega-ohm. The maximum necessary static voltage value is about several times as high as the depth of the pseudo-harmonic potential that is prepared by the ion trapping radio frequency quadrupole field. In this Embodiment, it is about 1V~100V. The static potential for the linear ion trapping mass spectrometry section is the ground potential. A radio-frequency power source and a static voltage power source for applying the radio frequency voltage and the static voltage are collectively shown as a power source 25 in FIG. 1A.

The foregoing devices are controlled by a computer 29. In FIG. 1, arrows directed out of and into the computer 29 represent the flows of control signals and measured signals.

The operation procedure of this embodiment for mass analysis of positive ions is described in the following. Methods of application to negative ions is also evident from this description.

First, we prepare the apparatus ready to accumulate ions. For trapping the specimen ions in the direction perpendicular to the central axis, a radio frequency voltage capable of stably trapping the specimen ions as calculated by the Equation 2 and the Equation 3 is applied to each of the electrode structure sections. In order that ions formed in the ion source are moved from the ion source section to the linear ion trapping mass spectrometric section, a static potential difference is provided between the two sections. The potential difference should be smaller than the depth D of the ion trap pseudo-harmonic potential formed by the radio frequency voltage calculated according to the Equation 4. Since this voltage difference accelerates the ions, the voltage difference should be kept smaller than the voltage applied to the end electrode section (represented by electrodes 13 and 14) so as to avoid the loss of the accelerated ions out from the end electrodes. For positive ions, the ion source section should be held at a positive static voltage relative to the ion source section. For negative ions, the sign should be reversed. The end electrode section, represented by electrodes 9 and 10, should be kept at a static voltage higher than that of the ion source section, so that the specimen ions do not escape out from the end electrode section along the center axis. For positive ions, a positive static voltage is applied to the planar concave electrodes 17–20. The vacuum vessel is filled with a helium gas at about 0.01 Torr so that the ions will be cooled down by collision with helium. The helium gas can be a carrier gas from the pretreatment apparatus.

Next, the specimen ions are accumulated. The electron source 21 and the specimen source 23 are switched on to produce specimen ions inside of the ion source section comprising the electrodes 5–8. The number of accumulated ions is controlled by adjusting the duration of the electron bombardment by the electron source 21. The generated ions move to the linear ion trap mass spectrometric section, which is at a potential lower than the ion source section. After entering the linear ion trapping mass spectrometric section, the specimen ions are cooled by the collision with the helium gas, loosing kinetic energy. As the cooling proceeds, the specimen ions are stored at the bottom of the harmonic potential formed along the central axis of the electrode structure by the voltage applied to the planar concave electrodes 17–20. When the accumulation of specimen ions is completed, the electron beam from the electron source 21 is stopped. The accumulation time should be adjusted to optimize the ionizing and mass analysis performance.

Next, we prepare for the mass spectrometric operation. First, we must avoid the degrading of the mass resolving power of the linear ion trapping mass spectrometric section, which is caused by the static voltages applied to the end electrode sections 13–16 and the ion source electrodes 5–8. To avoid the degrading, we set the voltages applied to the end electrode section and the ion source section to a potential equal with the ion trapping section, that is, to the grounded potential in this embodiment. In this state, the ions are trapped in the direction of the central axis by the harmonic potential formed by the static voltage 32 applied to the planar electrodes 17A, 17B–20A, 20B (refer to FIG. 2A, FIG. 2B). To limit the direction of emitting the ions only to the direction toward the ion detector, a minute positive static voltage, which is low enough not to lower the mass resolving power, is applied to the ion source section. If one wishes to avoid this minute degradation of mass resolution by this potential, another ion detector should be placed on the other end side of the quadrupole electrode structure opposite to the detector 27.

Next, mass spectrometric operation is conducted to obtain a mass spectrum. An alternating voltage 31 for mass analysis is applied to the planar electrodes. As its frequency is scanned, ions satisfying the resonance condition start to oscillate resonantly in the electrostatic harmonic potential. When the energy is increased to larger than the depth of the potential formed by the planar electrodes 17A, 17B–20A and 20B, the ions are ejected from the end of the linear quadrupole electrode structure in the direction along the central axis. The ejected ions are detected by the ion detector 27.

By the operations described above, a resonance frequency and the number of ions can be measured for specimen ions having a specific mass-to-charge ratio. Since there is a functional relationship between the resonance frequency and the mass-to-charge ratio, the mass-to-charge ratio can be determined.

Now, we will derive the relation between the mass-to-charge ratio and the resonance frequency of the ions trapped inside the electrostatic harmonic potential. If we assume that the shape of the electrostatic harmonic potential, $\phi_{(z)}$, along the central axis, z, is described by the following Equation 10, the relationship between the frequency of the analyzing alternating current and the mass-to-charge ratio is given by the following Equation 11. In the equation, W represents the depth of the electrostatic harmonic potential, L represents the length for which the harmonic potential is applied, m/e represents the charge-to-mass ratio and ω represents the resonant frequency of the ions.

$$\phi_{(z)}=4Wz^2/L^2 \quad (10)$$

$$\omega^2=8eW/(mL^2) \quad (11)$$

According to Equation 11, the charge-to-mass ratio m/e can be determined from the resonance frequency of the ions. The constant parameter ($W/L^2$) can be experimentally determined (or calibrated) by measuring ω of ions whose mass-to-charge ratio is known.

EMBODIMENT 2

(Embodiment using atmospheric pressure chemical ionization and an array of rectangular planar electrodes)

Figure 3:
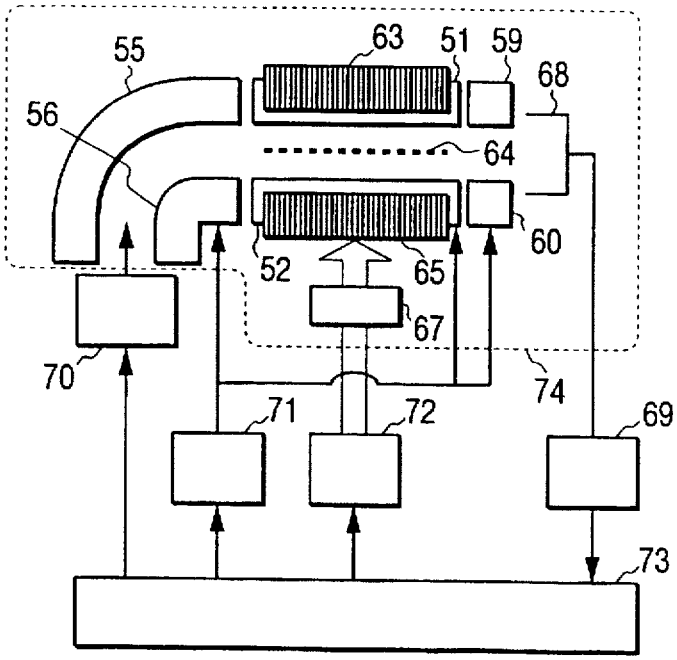
FIG. 3 is a block diagram for the entire constitution of a preferred embodiment using an atmospheric pressure ionization method and an array of rectangular planar electrodes according to the present invention in a cross-sectional view like that in FIG. 1A.

In this Embodiment 2, we describe an example of a mass spectrometric apparatus using an array of rectangular planar electrodes with reference to FIG. 3 and FIG. 4.

Embodiment 2 comprises a linear ion trapping mass spectrometric section and an atmospheric pressure chemical ionizing means as an ion source. Since this atmospheric ionization method gives less impact to the molecules than electron bombardment ionization used in the previous embodiment 1, it is possible to suppress the undesirable effect of fragmentation of the molecules.

As shown in FIG. 3, inside a vacuum vessel 74, this embodiment comprises an ion introduction channel composed of curved electrodes 55, 56, and corresponding two other electrodes not illustrated here. Also inside the vacuum vessel are linear ion trapping mass spectrometric electrodes 51–54, end electrode sections 59–62, and an ion detector 68. Outside the vacuum vessel, the embodiment comprises an atmospheric ion source 70, an ion trapping radio frequency power source 71, an analyzing alternating power source 72, an ion counting system 69 and a computer 73 for sequence control. FIG. 4B shows the cross sectional structure of the linear ion trapping mass spectrometric section, where the four quadrupole electrodes and rectangular electrodes are shown.

Figure 4A:
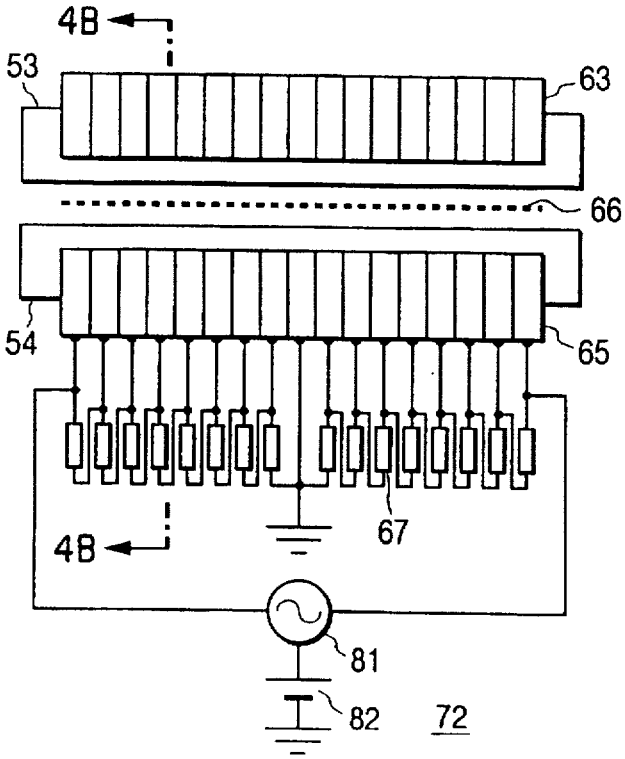
FIG. 4A is a block diagram for the detailed constitution of the mass spectrometric section in the embodiment shown in FIG. 3 and the constitution of an electric circuit, in a cross-sectional view taken along an arrow at a position 4A—4A in FIG. 4B.
Figure 4B:
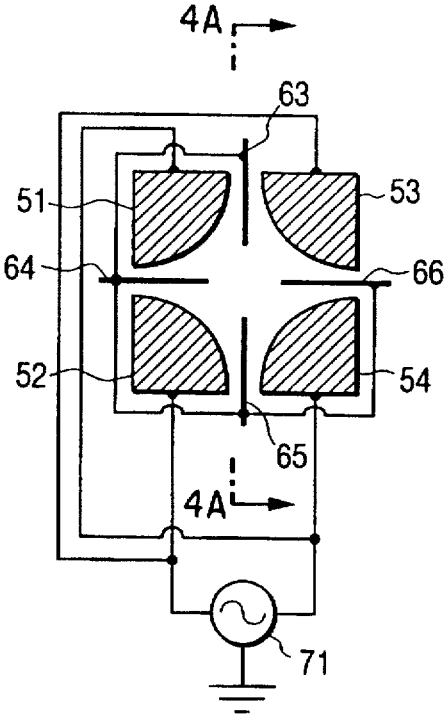
FIG. 4B is a cross-sectional view for an electrode portion taken along an arrow at a position 4B—4B in FIG. 4A and a constitution of an electric circuit.

First, we shall describe the linear ion trapping mass spectrometric section using FIGS. 4A and 4B. In this embodiment, ions are trapped in the direction along the central axis and are mass analyzed using four planar arrays 63–66 of small rectangular electrodes, instead of the bisected planar electrodes 17–20 of Embodiment 1 shown in FIGS. 1 and 2. The electrode structure of the linear ion trapping section and the radio frequency voltage to be applied are the same as those in Embodiment 1. The arrays 63–66 of small planar electrodes for trapping ions in the direction along the central axis and for mass analysis comprise small rectangular electrodes of practically the same size. The small electrodes are supported by insulating material. All the four arrays have the same number of electrodes, whose positions along the coordinate of the center axis are the same for all the arrays. The arrays are inserted between the gaps of the four linear quadrupole electrodes, and are at an equal distance from the central axis.

For electrical wiring, the small electrodes are grouped into sets of four electrodes each, with one electrode from each of the four arrays. The four electrodes in a set have the identical position on the coordinate along the central axis, and are short-circuited to each other. An appropriate static voltage is applied to each set of the small electrodes so that an approximate harmonic potential is formed on the central axis. It is convenient to use a static voltage power source 72 and divide the static voltage generated by the power source by resistors so that predetermined voltages are applied to each set of the small electrodes. The electrode set situated at the central portion is at the same electrostatic potential as the four ion trapping quadrupole electrodes. Adjacent electrodes are wired by electric resistors 67 (a reference numeral is designated for only one of a typical example). The resistance values are chosen so that the voltages applied to the small electrodes have quadratic relationship along the center axis direction of the electrode structure. To resonantly oscillate the ions along the direction of the central axis of the electrode structure, an analysis alternating voltage is applied to both ends of the resistors by using an alternating power source 81 which is capable of frequency scanning.

In this embodiment, ion introduction channel electrodes 55–56, each having a curvature (in FIG. 3, only electrodes 55, 56 are shown among the four electrodes actually used), are used. This is to avoid the neutral molecules, which are ejected from the ion source without being ionized, from colliding against the ion trapping mass spectrometric section. Without this curved ion channel, such molecules would be deposited on and contaminate the electrodes, deteriorating the mass resolving power.

In this embodiment, the mass analysis operation method for positive ions is essentially equal with that of Embodiment 1, as briefly described below. Methods of application to negative ions is also evident from this description.

Before mass spectrometric measurement, a radio-frequency voltage is applied to the entire quadrupole section. A static voltage, not greater than the depth D of the ion trap pseudo-harmonic potential of the ion trapping mass spectrometric section, is applied to the ion introduction channel and the end electrode sections. A static voltage for forming a electrostatic harmonic potential is applied to the arrays of planar electrodes. After all the necessary voltages are switched on, specimen ions are introduced. The introduced ions are cooled by the collision with a helium buffer gas and accumulated near the central portion of the ion trapping mass spectrometric section. After the end of the ion accumulating operation, the static voltages applied to the end electrode sections and the ion introduction channel portions are brought to the same potential as that for the ion trapping mass spectrometric section. Now, the static potential by the arrays of planar electrodes traps the ions in the direction of the central axis.

Successively, mass spectrometric operation is conducted. The analysis alternating voltage is applied, and its frequency is scanned. The ions satisfying the resonance condition will gradually increase their amplitude while oscillating in the axial direction. They will finally be ejected from the end of the electrode structure. The resonance frequency is converted to the mass-to-charge ratio using Equation (11) and a calibration method described in Embodiment 1.

EMBODIMENT 3

(Embodiment using a quadrupole mass filter and arrays of buried electrodes)

Figure 5:
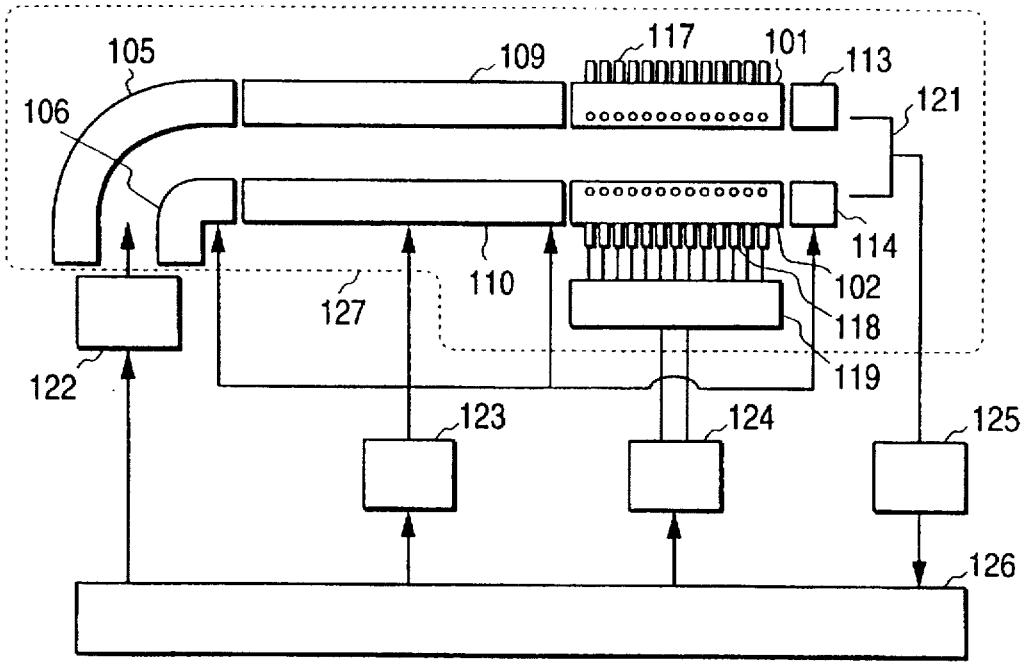
FIG. 5 is a block diagram for the entire constitution of a preferred embodiment using an array of buried electrodes and having a quadrupole mass filter according to the present invention in a cross-sectional view like that in FIG. 1A.
Figure 6A:
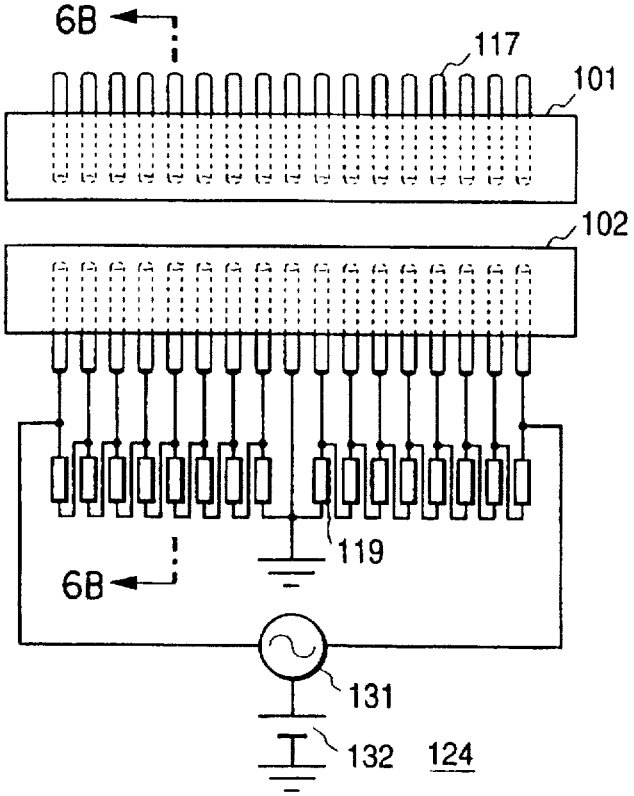
FIG. 6A is a block diagram for the detailed constitution of the mass spectrometric section in the embodiment shown in FIG. 5 and the constitution of an electric circuit in a cross-sectional view taken along an arrow at a position 6A—6A in FIG. 6B.

As Embodiment 3, we shall describe an example of a high sensitivity mass spectrometric apparatus comprising a quadrupole mass filter and arrays of buried electrodes in a linear ion trapping mass analyzer, with reference to FIG. 5 and FIG. 6. An idea of realizing high sensitivity mass analysis by using the quadrupole mass filter to remove undesired ions is disclosed in PCT/JP95/01322 (refer to WO97/02591 if necessary) filed previously by the present applicant. The linear ion trapping mass spectrometric section in this embodiment uses a method of burying a plurality of electrodes, which are covered by insulator material, into the linear ion trapping quadrupole electrodes and applying a static voltage thereto, thereby preparing a harmonic potential on the central axis.

Figure 6B:
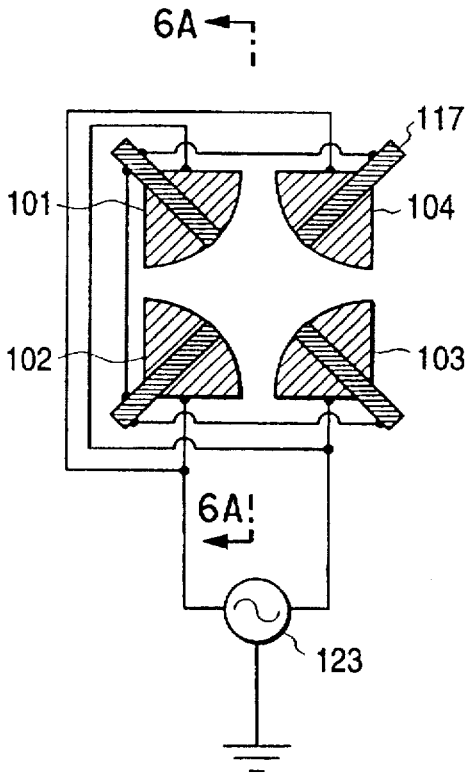
FIG. 6B is a cross sectional view for an electrode portion taken along an arrow at a position 6B—6B in FIG. 6A and a constitution of an electric circuit.

An atmospheric pressure chemical ionizing source 122 is used for the ion source, as in Embodiment 2. The embodiment uses an ion introduction channel, which is composed of electrodes 105, 106, each having a curvature (in FIG. 5, only the two electrodes 105, 106 are shown among the four electrodes actually used). Quadrupole mass filter electrodes 109–112, linear ion trapping mass spectrometric section electrodes 101–104 and end electrodes 113–116 are disposed colinearly to the exit portion of the ion introduction channel electrodes 105 and 106. An ion detector 121 is disposed next to the exit of the end electrodes. FIG. 6B shows a cross sectional structure of a linear ion trapping mass spectrometric section in this embodiment.

Next, we shall describe the linear ion trapping section of this embodiment. In each of the ion trapping electrodes 101–104, an identical number of fine rod electrodes 117 (only one of typical examples carries the reference numeral) are buried at an equal interval along a line, to form an array of rod electrodes. Each rod is so buried that an edge of the rod appears on the quadrupole electrode surface closest to the central axis of the ion trapping electrode structure. All the four quadrupole electrodes have identical positions of the buried fine rods as for the coordinate along the central axis of the quadrupole structure. Each buried fine rod electrode 117 is surrounded with an insulator sheath, which electrostatically insulates the rod from the ion trapping electrode. Since this configuration is an effective capacitor for a radio frequency band, the rods are substantially conductive regarding the ion trapping radio frequency. For electrical connection, the buried fine rod electrodes are grouped into sets of four electrodes each, with one electrode from each of the four arrays. The four electrodes in a set have the identical position on the coordinate along the central axis, and are so wired to be electrostatically conductive but insulated in the radio frequency band. This can be attained by wiring the four fine rod electrodes to one another with high resistors. The sets of four fine rod electrodes are so wired that static voltages in a quadratic relationship are applied by the divider resistors 119 (only one of typical examples carries the reference numeral), as in the case of the arrays of rectangular electrodes already described in Embodiment 2.

Next, we shall explain the operation of this embodiment for mass analysis of positive ions. Methods of application to negative ions is also evident from this description.

First, radio frequency is applied to the entire electrode structure. The quadrupole mass filter is set so as to operate with parameters that only the specimen ions are allowed to pass, but undesired ions (or, background ions) are not allowed to pass. Electrostatically, the ion source 122 is maintained at the ground potential. The ion introduction channel is maintained at an electrostatic voltage lower than the ion source. The quadrupole mass filter is electrostatically maintained at a voltage lower than the ion introduction channel. The ion trapping mass spectrometric section is electrostatically maintained at a voltage lower than the quadrupole mass filter, where the difference voltage should be much smaller than the depth D of the pseudo-harmonic ion trapping potential of the ion trapping mass spectrometric section, so as to minimize acceleration and loss of ions. The end electrode section is maintained at a voltage higher than the ion source. A static voltage is also applied to the arrays of the fine rod electrodes for forming a harmonic potential on the central axis.

Next, the specimen ions are introduced. Ions passing the ion introduction channel (electrodes 105, 106) are introduced into the quadrupole mass filter section (electrodes 109–112), where undesired background ions are eliminated. Thus, desired ions are accumulated in the ion trapping mass spectrometric sections 101–104, without undesirable background ions. The accumulated ions will lose kinetic energy by collision with helium buffer gas, and accumulate near the central portion of the linear trap structure.

After the ion accumulation, entry of new ions into the quadrupole mass filter section is prevented by changing the static voltage of the ion introduction channel to a higher value than the ions source, or by switching off the radio-frequency potential for the ion introduction channel section. Then, the electrostatic voltage of the end electrode is brought to the same electrostatic voltage as the quadrupole mass filter section. Successively, a mass analysis alternating voltage is applied to the arrays of fine rod electrodes as its frequency is scanned. When the frequency coincides with the resonant frequency of ions with corresponding mass-to-charge ratio, the ions oscillate resonantly and are ejected in the colinear direction from the trap. Ions are detected by the ion detector 121 to obtain a mass spectrum.

EMBODIMENT 4

(Embodiment using thin film electrodes attached on the surface of the quadrupole electrodes to form a electrostatic harmonic potential)

Figure 12:
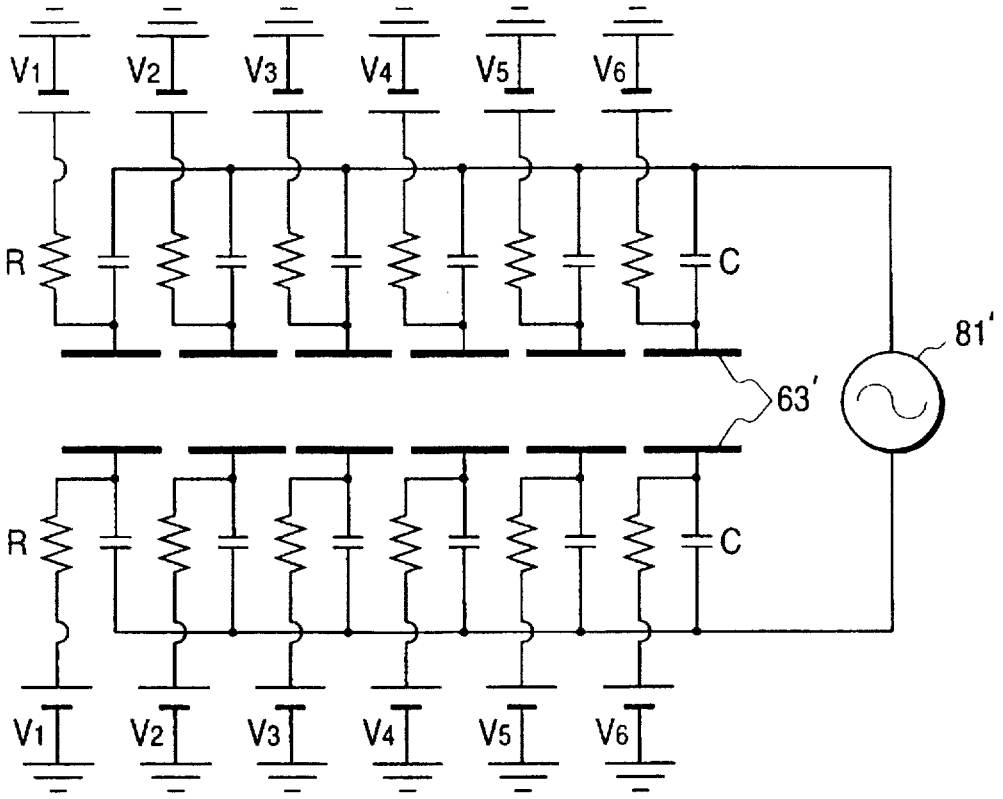
FIG. 12 shows an example of an equivalent circuit for the electric circuit in the embodiment shown in FIG. 1.

As Embodiment 4, we shall describe an example of preparing electrodes for forming the electrostatic harmonic potential by appending islands of film electrodes on the surface of the quadrupole linear electrodes, with reference to FIG. 11 and FIG. 12. This embodiment differs from Embodiment 2 only in the type of electrodes used to form electrostatic harmonic potential on the central trap axis. In Embodiment 4, film electrodes on the surface of the linear trap quadrupole electrodes are used, whereas, in Embodiment 2, rectangular electrodes are inserted between the gaps of the quadrupole trap electrodes. FIGS. 11A and 11B show an embodiment of the film electrodes, that correspond to the inserted rectangular electrodes shown in FIG. 4 of Embodiment 2. The film electrode structure in this Embodiment 4 is also applicable to the linear ion trapping mass spectrometric sections for Embodiments 1 and 3 described previously.

As shown in FIG. 11A, film electrodes 63' are disposed at equal intervals on the surfaces of the quadrupole linear electrode 51' and 52' to form an array of film electrodes for attaining static field harmonic potential along the trap axis. The film electrodes 63' are appended on the insulation film 80 on the surface of the linear quadrupole electrode as shown in FIG. 11C. Although not illustrated in the figure, the film electrodes 63' in an array are connected to one another with resistors as in FIG. 4, where the connecting wires reach the films through the gaps between the quadrupole electrodes. A static voltage applied to both ends are distributed among the film electrodes according to the resistivity distribution of the resistors.

FIG. 12 shows an example of an equivalent electric circuit for forming the electrostatic harmonic potential by this embodiment. A static capacitor C represents the stray capacitance between a film electrode 63' and the quadrupole electrodes 51' and 52', between which lies the insulative film 80 as described above. An alternating power source 81' corresponds to the alternating power source 81 in FIG. 4. $V_1$, $V_2$,—$V_6$ represent static voltages on the films, which are distributed by the divider resistors described above. To both ends of the array of divider resistors, voltages are supplied by static voltage sources (not illustrated) corresponding to the static voltage source 82 in FIG. 4. A resistor R represents resistivity between the voltages sources and the films. As apparent from the figure, the alternating voltage is supplied to the films through the capacitors C and the static voltages are supplied through the resistors R to each of the film electrodes 63' in this embodiment.

EMBODIMENT 5

(Embodiment in a case of ejecting ions in the direction perpendicular to the central axis of the ion trap)

This embodiment is an example of avoiding the lowering of the mass resolving power which is a problem in the mass selective instability operation or the mass selective resonance ejection operation in linear ion traps as described in the paragraph of the prior art. As explained in the paragraph for the summary of the invention, this embodiment shields the ions ejected from the vicinity of end sections of the linear ion trap, so that the ions do not reach the ion detector.

The entire constitution of the mass spectrometry apparatus using this embodiment may be obtained, for example, by replacing the linear ion trapping mass spectrometric sections in Embodiments 1 to 4, shown previously, with a linear ion trapping mass spectrometric section explained in this embodiment.

In the mass selective instability mode, ions are ejected from an ion extraction hole perforated in the linear electrode outward in the direction perpendicular to the central axis of the linear ion trapping electrode structure. In the mass selective resonance ejection mode, ions are ejected in the direction perpendicular to the central axis of the linear ion trapping electrode structure through the ion extraction hole perforated in the linear electrode, or from the gap between the electrodes. An ion detector is disposed at a place capable of detecting the thus ejected ions.

To attain a mass resolving power $\Delta m/m$, the size and the position of the shield or the perforated hole is calculated by the Equation 9. When the shield plate is used, it is desirable to dispose the shield plate close to the linear electrode.

Figure 13:
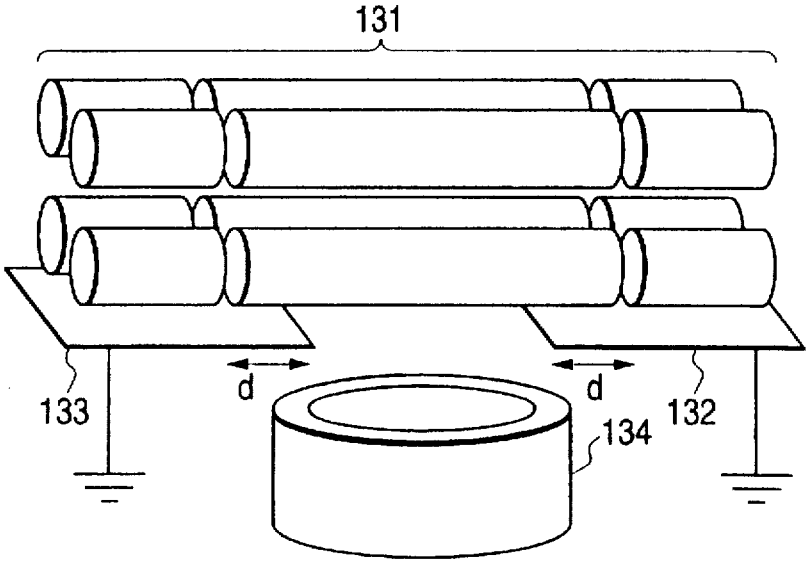
FIG. 13 is a perspective view showing a relationship between a linear ion trapping electrode structure section and an ion detection section adopting an ion shield plate according to the present invention.

FIG. 13 shows a positional relationship between the linear quadrupole electrode structure 131, ion shield plates 132, 133 and ion detector 134 in a case of ejecting ions through the electrode gap in the mass selective resonance ejection mode. Each ion shield extends toward the linear ion trapping mass spectrometric section by a length d from a junction position between the end electrode section and the linear ion trapping mass spectrometric section. The length d is determined by Equation 8. Specifically, the shielding length d is 2.6 $r_0$ to obtain a mass resolving power $\Delta m/m \approx 10^{-3}$, when the depth D of the ion trap potential is D=1[V] and the end electrodes are at a higher electrostatic potential than the ion trap electrodes by V=1[V].

EMBODIMENT 6

(Embodiment of optically detecting the ions)

Figure 14:
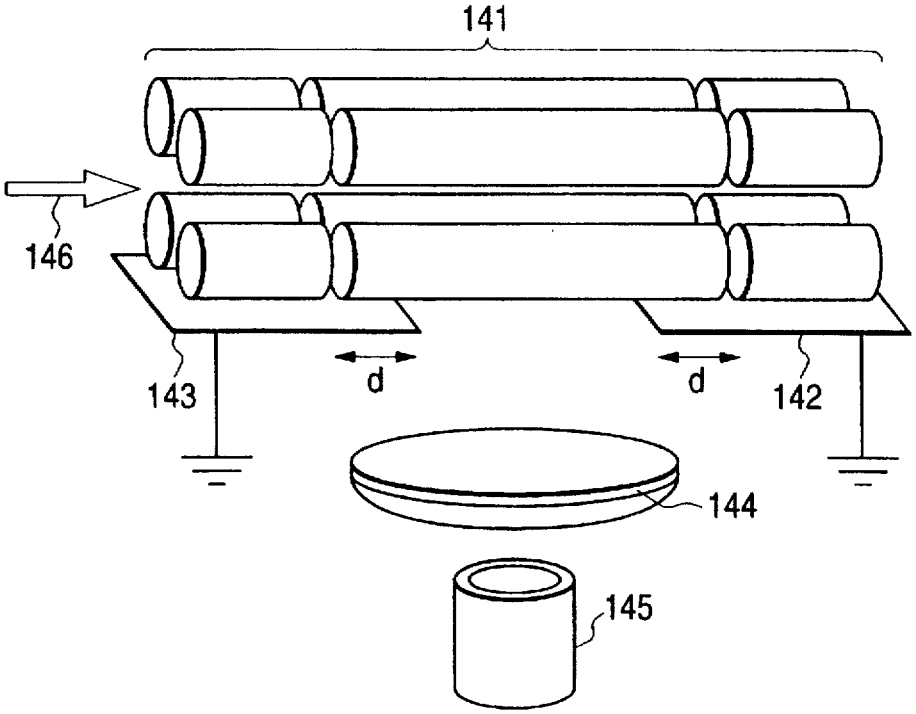
FIG. 14 is a perspective view showing a relationship between a linear ion trapping electrode structure section and an ion detection section adopting a light shield plate according to the present invention.

In the ion trapping mass spectrometric method of optically detecting specimen ions (refer to U.S. patent application Ser. No. 08/626,560 filed Apr. 2, 1996: literature 4), the mass resolving power can be improved by shielding the fluorescence emitted from the portion near the end electrodes. Since Literature 4 describes, in detail, the ion trapping mass spectrometric method for optically detecting specimen ions, the constitution of apparatus and the operation method, we will here explain only the shield plate used upon observing the fluorescence. FIG. 14 shows a linear ion trapping mass spectrometric section 141, light shield plates 142, 143, an objective lens 144, a light detector 145 and a laser beam 146 for exciting fluorescence of trapped ions.

As in Embodiment 5, each ion shield extends toward the linear ion trapping mass spectrometric section by a length d from a junction position between the end electrode section and the linear ion trapping mass spectrometric section. The length d is determined by the Equation 8. More specifically, for obtaining a mass resolving power $\Delta m/m \approx 10^{-3}$, the shield length should be longer than 2.6 $r_0$., in a case of the ion trapping potential depth D=1[V] and application of an end electrode voltage higher by V=1[V] compared to the linear ion trapping quadrupole electrodes.

Figure 15A:
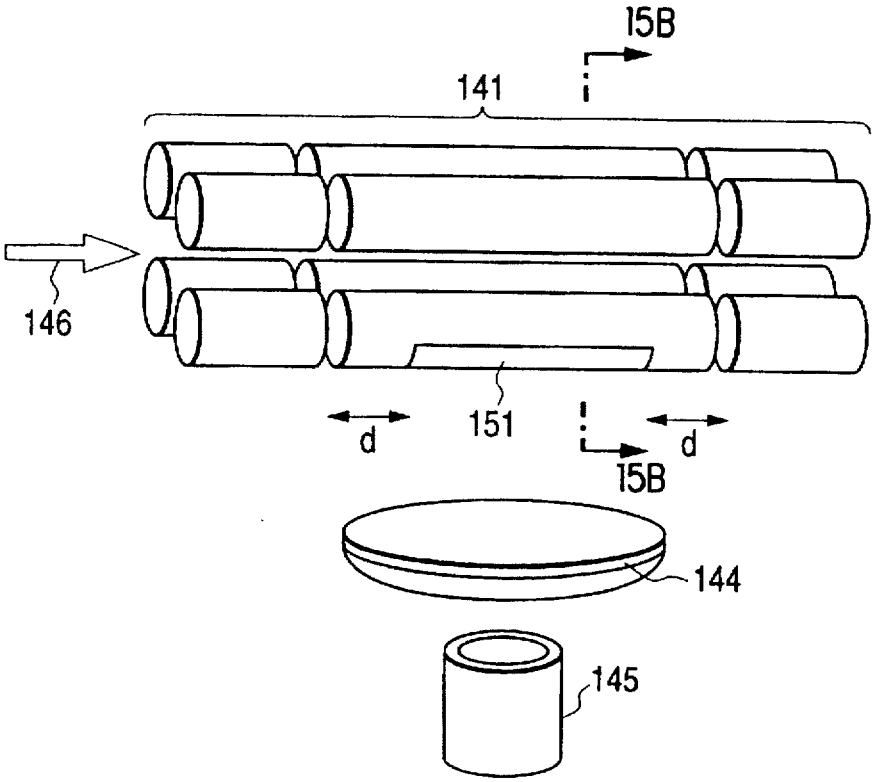
FIG. 15A is a perspective view illustrating a block diagram for a relationship between a linear ion trapping electrode structure section and an ion detection section of an embodiment in which a light extraction portion is disposed to the electrode instead of the light shield plate in FIG. 14.
Figure 15B:
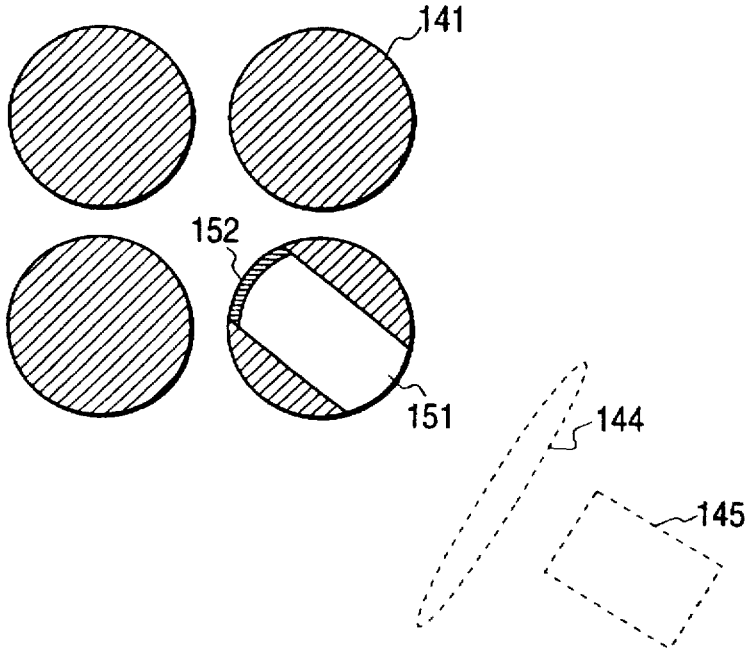
FIG. 15B is a cross-sectional view of an electrode portion taken along an arrow at a position 15B—15B in FIG. 15A.

Instead of the light shield plate described above, a hole 151 may be perforated, for the same purpose, in the electrodes of the linear ion trapping mass spectrometric section, as shown in FIG. 15A and FIG. 15B. The fluorescence light is extracted from this hole for detection. The position and the length of such holes can also be calculated from Equation 8. As can be seen from FIG. 15B illustrating the cross sectional shape of the electrode section, the light extraction hole 151 penetrates through the central portion of a quadrupole electrode 141 perpendicularly to the electrode axis. A conductive mesh 152 is disposed to the side of the ion trapping region in the same shape as that of the electrode surface in order that the electric field inside the linear ion trapping region is not disturbed by the hole. Accordingly, fluorescence generated in the ion trapping region is transmitted through the mesh 152 and the light extraction hole 151, collected by the objective lens 144 and then detected by the light detector 145, as shown in FIG. 15B.

According to the present invention, the analyzing sensitivity and the mass resolving power of the existent ion trapping mass spectrometric method can be improved.

What is claimed is:

1. An ion trapping mass spectrometry apparatus comprising a linear ion trapping electrode structure, a driving power source for trapping ions in the linear ion trapping electrode structure, end electrodes disposed at the end or at an extended portion in the direction of the central axis of the linear ion trapping electrode structure and having a central axis in common for preventing ions from escaping out of the linear ion trapping electrode structure in the direction along the central axis of the electrode structure, a power source for applying a predetermined static voltage to the end electrodes, an ionization means for ionizing a specimen and introducing the ions to the linear ion trapping electrode structure, means for exciting the ions kinetically to oscillate in the linear ion trapping electrode structure and ejecting the oscillated ions to the outside of the electrode structure, and an ion detection means for detecting the ejected ions, further comprising, means for eliminating the effect of the static voltage of the end electrode upon ejecting ions under selection of mass from the linear ion trapping electrode structure.

2. A mass spectrometry apparatus according to claim 1, wherein the means for eliminating the effect of the static voltage of the end electrodes comprises means for preparing an electrostatic harmonic potential or approximately harmonic potential along the central axis of the linear ion trapping structure and means for preparing an alternating current electric field for exciting the ions kinetically to oscillate along the direction of the central axis inside the linear ion trapping electrode structure.

3. A mass spectrometry apparatus according to claim 2, wherein the means for preparing the electrostatic harmonic potential or approximately harmonic potential along the central axis of the linear ion trapping electrode structure comprises a planar electrode inserted into one or plurality of gaps formed by adjacent electrode pairs of the linear ion trapping electrode structure, which are formed into an appropriate shape, divided into plurality in the direction of the central axis, where each divided portions are applied with a predetermined static voltage and an alternating current voltage for mass analysis.

4. A mass spectrometry apparatus according to claim 3, wherein the planar electrode is formed by arranging an array of a plurality of rod-shaped electrodes being insulated respectively, and applied with appropriate electrostatic and alternating current voltages to each of said rod-shaped electrodes.

5. A mass spectrometry apparatus according to claim 2, wherein the means for preparing the electrostatic harmonic potential or approximately harmonic potential along the central axis of the linear ion trapping electrode comprises an array of a plurality of fine rod electrodes that are buried, while being insulated, into one or plurality of quadrupole electrodes of the linear ion trapping electrode structure, so that an end portion of the fine rod electrode is exposed to the surface of the quadrupole electrode structure facing the central axis, further comprising means to apply, to each of the fine rod electrodes, an appropriate electrostatic voltage for forming harmonic potential and an appropriate alternating current voltage for mass analysis.

6. A mass spectrometry apparatus according to claim 2, wherein the means for preparing the electrostatic harmonic potential or approximately harmonic potential comprises an array of film electrodes disposed on the surface, facing the central axis, of one or plurality of quadrupole electrodes of the linear ion trapping electrode structure while being electrostatically insulated from the quadrupole electrode, further comprising means to apply, to each of the film electrodes, an appropriate electrostatic voltage for forming harmonic potential and an appropriate alternating current voltage for mass analysis.

7. A mass spectrometry apparatus according to claim 6, wherein the means for preparing the electrostatic harmonic potential or approximately harmonic potential comprises an array of film electrodes which are formed into an appropriate shape and appended on the surface of an insulation film attached on the surface of one or plurality of electrodes of the linear ion trapping electrode, further comprising means to apply, to each of the film electrodes, an appropriate electrostatic voltage for forming harmonic potential and an appropriate alternating current voltage for mass analysis.

8. An ion trapping mass spectrometry apparatus comprising a linear ion trapping electrode structure, a driving power source for trapping ions in the linear ion trapping electrode structure, end electrodes disposed at the end or at an extended portion in the direction of the central axis of the linear ion trapping electrode structure and having a central axis in common for preventing the ions from escaping out of the linear ion trapping electrode structure in the direction along the central axis, a power source for applying a predetermined static voltage to the end electrodes, an ionization means for ionizing a specimen and introducing the ions to the linear ion trapping electrode structure, means for exciting the ions kinetically to oscillate in the linear ion trapping electrode structure and ejecting the oscillated ions to the outside of the electrode structure, and an ion detection means for detecting the ejected ions, where said ions are ejected by a radio-frequency voltage applied to the linear ion trapping electrodes so as to excite the ions kinetically to oscillate in a direction perpendicular to the central axis of the linear ion trapping electrodes, further comprising, means for preventing the ions, that are ejected at a predetermined portion near the end electrode, from reaching the ion detection means.

9. An ion trapping mass spectrometry apparatus comprising a linear ion trapping electrode structure, a driving power source for trapping ions in the linear ion trapping electrode structure, end electrodes disposed at the end or at an extended portion in the direction of the central axis of the linear ion trapping electrode structure and having a central axis in common for preventing the ions from escaping out of the electrode structure of the linear ion trapping electrode structure in the direction along the central axis, a power source for applying a predetermined static voltage to the end electrodes, an ionization means for ionizing a specimen and introducing the ions to the linear ion trapping electrode structure, means for exciting the ions kinetically to oscillate in the linear ion trapping electrode structure, and an ion detection means for detecting the oscillated ions, where said ions are detected by optical means such as the detection of fluorescence emitted directly from the specimen ions by irradiation of an excitation light or fluorescence emitted by other ion species trapped in the ion trap together with the specimen ions by irradiation of an excitation light, further comprising, means for preventing the fluorescence emitted from a predetermined portion near the end electrode from reaching the fluorescence detection means.

10. A mass spectrometry apparatus according to claim 9, wherein the linear ion trapping electrode is equipped with a hole, through which the fluorescence from only a predetermined region of the linear ion trapping electrode is allowed to pass, instead of the means for preventing the fluorescence emitted from the predetermined portion near the end electrode from reaching the ion detection means.

11. A mass spectrometry apparatus according to claim 9, wherein the prevention of the fluorescence emitted from a predetermined portion near the end electrode from reaching the fluorescence detection means is achieved by avoiding irradiation of light for fluorescence excitation of ions over a predetermined portion near the end electrode.

* * * * *

UNITED STATES PATENT AND TRADEMARK OFFICE

CERTIFICATE OF CORRECTION

PATENT NO. : 5,783,824

DATED : 21 July 1998

INVENTOR(S) : Takashi BABA et al.

It is certified that error appears in the above-indentified patent and that said Letters Patent is hereby corrected as shown below:

| Column | Line | |
|---|---|---|
| 4 | 60 | Before "drawbacks" insert --there are--; delete "may be pointed out", change "to" to --in--. |
| 9 | 59 | Change "does not" to --do not--. |
| 10 | 2 | Change "is" to --are--. |
| 10 | 3 | Change "short-circuitted" to --short-circuited--. |
| 10 | 13 | Change "does not" to --do not--. |
| 10 | 23 | Change "is" to --are--. |
| 10 | 28 | Change "where an" to --wherein--. |
| 10 | 38-39 | Change "is inserted" to --are inserted--. |
| 11 | 16 | Before "that" insert --in--. |

UNITED STATES PATENT AND TRADEMARK OFFICE

CERTIFICATE OF CORRECTION

PATENT NO. : 5,783,824

DATED : 21 July 1998

INVENTOR(S) : Takashi BABA et al.

It is certified that error appears in the above-indentified patent and that said Letters Patent is hereby corrected as shown below:

| Column | Line | |
|---|---|---|
| 11 | 18 | Change "elected" to --ejected--. |
| 14 | 7 | Before "undesired" insert --the--. |
| 14 | 53 | Change "ionize" to --ionizes--. |
| 15 | 52 | Change "sections" to --section--. |
| 20 | 25 | Before "voltage" insert --in--. |
| 21 | 32 | Change "voltages" to --voltage--. |
| 23 | 1 | Change "the" to --an--. |
| 23 | 2 | Change "electrodes" to --electrode--; before "specimen" change "a" to --the--. |

Signed and Sealed this

Sixteenth Day of November, 1999

*Attest:*

*Attesting Officer*

Q. TODD DICKINSON

*Acting Commissioner of Patents and Trademarks*